US008205408B2

(12) United States Patent
Houghton et al.

(10) Patent No.: US 8,205,408 B2
(45) **Date of Patent: *Jun. 26, 2012**

(54) BUILDING METAL FRAME, AND METHOD OF MAKING, AND COMPONENTS THEREFOR INCLUDING COLUMN ASSEMBLIES AND FULL-LENGTH BEAM ASSEMBLIES

(75) Inventors: David Houghton, Cypress, CA (US); Jesse E. Karns, Long Beach, CA (US); Enrique A. Gallart, Mission Viejo, CA (US)

(73) Assignee: Mitek Holdings, Inc., Wilmington, DE (US)

( * ) Notice: Subject to any disclaimer, the term of this patent is extended or adjusted under 35 U.S.C. 154(b) by 485 days.

This patent is subject to a terminal disclaimer.

(21) Appl. No.: 12/315,666

(22) Filed: Dec. 3, 2008

(65) Prior Publication Data

US 2010/0043338 A1 Feb. 25, 2010

Related U.S. Application Data

(63) Continuation-in-part of application No. 12/229,272, filed on Aug. 21, 2008.

(51) Int. Cl.
*E04B 1/19* (2006.01)
*E04B 1/38* (2006.01)

(52) U.S. Cl. ..... 52/655.1; 52/653.1; 52/656.9; 52/657; 52/831

(58) Field of Classification Search ..... 52/653.1, 52/657, 656.9, 236.3, 167.3
See application file for complete search history.

(56) References Cited

U.S. PATENT DOCUMENTS 574,434 A * 1/1897 Keithley ..... 52/236.3

(Continued)

FOREIGN PATENT DOCUMENTS

GB 2402986 A 12/2004

OTHER PUBLICATIONS

International Search Report regarding PCT/US2009/053736 dated Dec. 17, 2009, 4 pages.

(Continued)

*Primary Examiner* — William Gilbert
*Assistant Examiner* — Chi Nguyen
(74) *Attorney, Agent, or Firm* — Senniger Powers LLP

(57) ABSTRACT

A building framework includes plural column assemblies interconnected by plural full-length beam assemblies, with the union of the column assemblies and beam assemblies forming beam-to-column joint assemblies according to this invention. The column assemblies include pairs of side plates spanning the column members of the column assemblies and projecting toward another column assembly of the plurality of such column assemblies. The full-length beam assemblies include beam members for being received between column assemblies to be interconnected and defining an end gap with respect to each column member. Additionally, the full-length beam assemblies include at each opposite end portion thereof a pair of cover plates, including an upper cover plate and a lower cover plate, which cover plates are sized and configured to be united with the side plates of a column assembly, as by welding applied at a construction site. The full-length beam assemblies may also include provisions for drawing together the side plates of a column assembly preparatory to welding, which side plates are sufficiently spaced apart to provide a "rattle" space allowing entry of an end portion of a full-length beam assembly between the side plates as a step in the erection process for the framework.

23 Claims, 16 Drawing Sheets

U.S. PATENT DOCUMENTS

| | | | | | |
|---|---|---|---|---|---|
| 1,883,376 | A | | 1/1932 | Hilpert et al. | |
| 1,899,799 | A | * | 2/1933 | Edwards | 403/188 |
| 2,943,716 | A | | 7/1960 | Babcock | |
| 3,058,553 | A | * | 10/1962 | Hawes | 403/186 |
| 3,938,297 | A | * | 2/1976 | Sato et al. | 403/188 |
| 3,952,472 | A | | 4/1976 | Boehmig | |
| 3,963,099 | A | | 6/1976 | Skinner et al. | |
| 4,014,089 | A | | 3/1977 | Sato et al. | |
| 4,220,419 | A | * | 9/1980 | Hawes | 403/189 |
| 5,174,080 | A | | 12/1992 | Yoshimura et al. | |
| 5,497,591 | A | | 3/1996 | Nelson | |
| 5,660,017 | A | | 8/1997 | Houghton | |
| 5,802,169 | A | | 9/1998 | Frantz et al. | |
| 6,009,674 | A | | 1/2000 | Root | |
| 6,059,482 | A | | 5/2000 | Beauvoir | |
| 6,138,427 | A | | 10/2000 | Houghton | |
| 6,219,989 | B1 | | 4/2001 | Tumura | |
| 6,237,303 | B1 | | 5/2001 | Allen et al. | |
| 6,516,583 | B1 | | 2/2003 | Houghton | |
| 6,591,573 | B2 | | 7/2003 | Houghton | |
| 6,634,153 | B1 | | 10/2003 | Peterson | |
| 6,802,169 | B2 | | 10/2004 | Simmons | |
| 7,178,296 | B2 | | 2/2007 | Houghton | |
| 7,637,076 | B2 | | 12/2009 | Vaughn | |
| 7,712,266 | B2 | | 5/2010 | Sarkisian | |
| 2002/0124520 | A1 | | 9/2002 | Bock et al. | |
| 2003/0208985 | A1 | | 11/2003 | Allen et al. | |
| 2010/0043348 | A1 | | 2/2010 | Houghton et al. | |

OTHER PUBLICATIONS

International Search Report regarding PCT/US2009/053758, mailed Mar. 30, 2010, 6 pages.

Office action issued Jun. 23, 2011 in related U.S. Appl. No. 12/315,805, 13 pgs.

Response filed Jul. 7, 2011 to Office Action dated Apr. 25, 2011 from related U.S. Appl. No. 12/229,272, 17 pgs.

Office action issued Aug. 2, 2011 in related U.S. Appl. No. 12/315,754, 11 pgs.

Response filed Aug. 24, 2011 to Office Action dated Apr. 25, 2011 from related U.S. Appl. No. 12/859,437; 19 pgs.

Office action dated Oct. 21, 2010 from U.S. Appl. No. 12/229,272, 11 pages.

Response filed Jan. 21, 2011 to Office action issued Oct. 21, 2010 in U.S. Appl. No. 12/229,272, 18 pages.

Office action dated Apr. 25, 2011 from U.S. Appl. No. 12/229,272, 12 pages.

Office action dated Nov. 29, 2010 from U.S. Appl. No. 12/315,754, 14 pages.

Response filed Mar. 28, 2011 to Office action issued Nov. 29, 2010 in U.S. Appl. No. 12/315,754, 17 pages.

Office action dated Nov. 29, 2010 from U.S. Appl. No. 12/315,805, 14 pages.

Response filed Mar. 28, 2011 to Office action issued Nov. 29, 2010 in U.S. Appl. No. 12/315,805, 18 pages.

Office action dated Apr. 25, 2011 from U.S. Appl. No. 12/859,437, 12 pages.

PCT International Search Report and Written Opinion regarding PCT/US2011/048441 dated Nov. 25, 2011, 12 pgs.

Supplemental Response filed Sep. 23, 2011 to Office Action dated Apr. 25, 2011 from related U.S. Appl. No. 12/229,272; 9 pgs.

Response filed Nov. 2, 2011 to Office Action dated Aug. 2, 2011 from related U.S. Appl. No. 12/315,754; 9 pgs.

Response filed Sep. 15, 2011 to Office Action dated Jun. 23, 2011 from related U.S. Appl. No. 12/315,805, 13 pgs.

Supplemental Response filed Sep. 23, 2011 to Office Action dated Jun. 23, 2011 from related U.S. Appl. No. 12/315,805, 13 pgs.

* cited by examiner

SECTION A-A

SECTION A-A

SECTION A-A

SECTION A-A

SECTION A-A

SECTION B -B

SECTION A - A

SECTION A-A

BUILDING METAL FRAME, AND METHOD OF MAKING, AND COMPONENTS THEREFOR INCLUDING COLUMN ASSEMBLIES AND FULL-LENGTH BEAM ASSEMBLIES

CROSS REFERENCE TO RELATED APPLICATION

This application is a Continuation-in-Part of U.S. application Ser. No. 12/229,272, filed 21 Aug. 2008, published as US Publication No. 2010/0043316, and incorporates by reference the disclosure of that earlier application to the extent necessary for a full enabling disclosure of the present invention.

BACKGROUND OF THE INVENTION

Buildings, towers and similarly heavy structures commonly are built on and around a steel framework. A primary element of the steel framework is the joint connections of the beams to the columns. An improved structural joint connection is disclosed in U.S. Pat. No. 5,660,017. However, advanced stress analysis techniques and a study of building collapse mechanisms following seismic and blast events (i.e., terrorist bombings) have resulted in the present improvements.

Further, consideration of the conventional building erection tasks and methodologies employed when erecting a building or constructing components for such a steel frame building (as well as the on-site erection of the buildings themselves), with joint connections including gusset plates (or side plates) spanning a column and receiving an end portion of a beam therebetween, has also resulted in the recognition of several inefficiencies or problem areas. Hereinafter, the gusset plates (or side plates) are referred to with either term (or with both terms) as one term has to do with the function of the plates as reinforcement or strengthening to a beam-to-column joint, and the other term has to do with the location of the plates on the sides of the columns and beams. Moreover, as a result of the deficiencies of the conventional technologies, construction costs and material costs for a steel frame building structure of conventional construction are significantly higher than necessary. That is, the current technology teaches a beam (or beams)-to-column joint structure for joining one or more beams in a supporting relationship to a column, with each joint structure including a pair of gusset plates (or side plates) spaced apart and spanning the column, and sandwiching between them the column and an end portion of a connecting beam or beams. The gusset plates or side plates extend outwardly from the column along the sides of the beam(s). Of course, as taught in U.S. Pat. No. 5,660,017, the gusset plates may extend in both directions from a column so that they extend across the column, and connect two beams together, in a supporting relationship to the interposed column.

Conventionally, in preparation for erection of such a steel frame building, column structures are shop fabricated, adding the gusset plates or side plates to column sections for one or more floors of the building to be erected at a building site. Between the gusset plates or side plates, an end portion (or stub) of connecting beam is secured into each joint assembly, as by welding. Additional components of the joint assembly are generally added to the columns at this time also, such as welded in vertical shear plates and welded in horizontal continuity plates or shear plates, which improve the strength and stiffness of the joint assemblies. These additional components also facilitate load transfer between the principal components of the joint assembly.

Such column structures or assemblies are then shipped to a construction site where the column assemblies for one or more of the lower floors of the building are properly aligned to one another, and are set in the building foundation. With the column assemblies so set and aligned, the conventional practice is then to connect each two aligning stub beams of adjacent column assemblies with a so-called link beam. This link beam is simply an elongate steel beam section generally matching the two stub beams to be connected, and of the proper length to fit between these stub beams with a proper welding root gap. The link beam is then welded in the field (i.e., at the construction site) at each of its ends to one of the aligned stub beams of the connected joint assemblies. Understandably, fitting such link beams into place, and making the field welds at each end of such link beams, which are necessary to structurally join the beam stubs and link beam, is a labor intensive and expensive process. The field welding necessary for this joining of beam stubs to link beams will require multiple passes, and it is to be understood that the beam stubs and link beam may be 30 inches to 42 inches, or more in the vertical dimension and 10 inches to 14 inches or more in the horizontal dimension, so each field weld (required to connect the web of a beam stub to the web of a link beam, and to connect the flanges of a beam stub to the flanges of a ling beam) is a big and labor intensive job to be done in the field. Further, these welding jobs must be performed at heights above the ground that make working and welding a somewhat risky operation. Depending on the design height of the building, construction of successive floors or groups of floors proceeds upwardly atop of the framework for the lower floors. Consequently, as the building grows upwardly, the heights at which such link-beam-to-beam-stub welds must be done grows progressively also.

Moreover, during the last several years, there has been considerable additional concern as to how to improve the beam-to-column, and beam-to-beam joint connections of a steel frame building so they will better withstand explosions, blasts and the like as well as other related extraordinary load phenomena. Of particular concern is the prevention of progressive collapse of a building if there are one or more column failures due to terrorist bomb blast, vehicular and/or debris impact, structural fire, or any other impact and/or heat-induced damaging condition.

Column failures due to explosions, severe impact and/or sustained fire, have led to progressive collapse of entire buildings. An example of such progressive collapse occurred in the bombing of the A. P. Murrah Federal Building in Oklahoma City in 1995 and in the aerial attack on the World Trade Center towers in 2001.

Following the 1994, Northridge, Calif. earthquake, in addition to the invention set forth in U.S. Pat. No. 5,660,017, a number of other alternatives to resist joint connection failure, were suggested or adopted for use in steel construction design for improved seismic performance. For example, the reduced beam section (RBS), or "dog bone" joint connection has been proposed, in which the beam flanges are narrowed near the joint connection. This alternative design reduces the plastic moment capacity of the beam allowing inelastic hinge formation in the beam to occur at the reduced section of the beam. This inelastic hinge connection is thought to relieve some of the stress in the joint connection between the beam and the column. An example is seen in U.S. Pat. No. 5,595,040, for Beam-to-Column Connection, which illustrates such "dog bone" connections. But, because the plastic moment capacity of the beam is reduced due to the narrowing of the beam flanges, the moment load which can be sustained by the beam is also substantially reduced.

Another alternative is illustrated by U.S. Pat. No. 6,237,303, in which slots and holes are provided in the web of one or both of the column and the beam, in the vicinity of the joint connection, in order to provide improved stress and strain distribution in the vicinity of the joint connection. Other post-Northridge joint connections are also identified in FEMA 350-Recommended Seismic Design Criteria for New Steel Moment Frame Building, published by the Federal Emergency Management Agency in 2000. All such post-Northridge joint connections have reportedly demonstrated their ability to achieve the required inelastic rotational capacity to survive a severe earthquake.

However, one important consideration to be noted in contrast to the present invention is that none of these alternative joint connections provide independent beam-to-beam structural continuity across a column; such continuity being capable of independently carrying gravity loads under a "double-span" condition resulting from a column being suddenly or violently removed by, for example, explosion, blast, impact or other means, regardless of the damaged condition of the column. Additionally none of these alternatives, except the gusset plates used as taught in U.S. Pat. No. 5,660,017, provide any significant torsion capacity or significant resistance to lateral bending to resist direct explosive air blast impingement and severe impact loads. Torsion demands for the joint are created because while the top flanges of the beams are typically rigidly attached to the floor system of a building against relative lateral movement, the bottom flange of the beam is free to twist when subjected to, for example, direct lateral blast impingement loads caused by a terrorist attack. A structure according to this invention will sustain such "double-span" conditions as well as demands from severe torsion loads; while also providing advantages in savings of material, weight, and labor. Indeed, there are no additional and discrete load paths across the column in the event of column failure or joint connection failure or both.

SUMMARY OF INVENTION

In view of the deficiencies of the prior joint connection technologies, and the elimination of these deficiencies in the improved current joint connection technology taught in U.S. Pat. No. 5,660,017, an object for this invention is to provide a structure and method for eliminating the need for stub beams and later addition of link beams in order to interconnect adjacent joint connections.

The present invention provides a metal frame building with multiple column assemblies each having gusset plates or side plates, with the joint connections including and being interconnected by beam assemblies which are substantially full-length between interconnected column assemblies. That is, no field-welded splices in these full length beam assemblies are required in order to interconnect adjacent joint connections with horizontal beam material. Instead, the joint connections are interconnected by a substantially full-length beam assembly which is welded into each joint connection, forming a unitary structure.

In view of the above, the present invention provides an improved building framework comprising: at least a pair of vertical column assemblies; each column assembly of the pair of column assemblies having a vertically elongate column member defining a horizontal dimension and a pair of horizontally spaced vertically and horizontally extending side plate members spanning the horizontal dimension of the column member and projecting generally horizontally toward the other column assembly of the pair; a full-length beam assembly disposed between the pairs of projecting side plates of the pair of column assemblies and including a beam member defining an end gap with each column member, and the full-length beam assembly including a pair of opposite cover plates each extending along an end portion of the beam member at each opposite end of the full-length beam assembly; and each of the pair of cover plates being received between a respective pair of projecting side plates of a respective column assembly.

Further, the present invention provides a steel frame building structure utilizing a plurality of such beam-to-column joint structures in a unified or holistic structure mutually supporting one another in the event of structural damage or obliteration of a part of the building structure, so that progressive building collapse is mitigated.

This invention provides component parts for making a building structure including a beam-to-column, and beam-to-beam structural joint connection, the component parts comprising: a full-length beam assembly for construction of a building framework, the building framework including a pair of spaced apart column assemblies each including a column member and a pair of laterally spaced apart side plates spanning the column member and projecting toward the other column assembly of the pair of column assemblies, the full-length beam assembly comprising: a beam member for extending between the column members of the pair of spaced apart column assemblies and for defining an end gap with each column member; the full-length beam assembly including an end portion at each opposite end thereof, and each end portion of the full-length beam assembly including a pair of opposite cover plates each extending along the end portion of the beam member, each pair of opposite cover plates including an upper cover plate and a lower cover plate, and at least one of the upper cover plates and the lower cover plates being configured and sized for receipt between a respective pair of projecting side plates of a respective column assembly of the pair of column assemblies. And further including a column assembly module for a building framework, the column assembly comprising: a vertically elongate column member defining a horizontal dimension; and a pair of horizontally spaced vertically and horizontally extending side plate members spanning the horizontal dimension of the column member and projecting together and generally in parallel horizontally therefrom; whereby a full-length beam assembly may be disposed between pairs of projecting side plates of a spaced apart pair of such column assembly modules to be welded thereto providing a beam-to-column joint assembly.

Among the advantages of this present invention are a recognition that when a seismic catastrophe occurs, or upon blast or explosion or other disastrous events, support from one or more of the columns of a building steel frame structure may be partially or totally lost. This may be due to loss of the column and/or partial or total failure of the beams-to-column joint connections. In either event, the prior conventional beam-to-column joint connections are then insufficient and unreliable. This is because extreme axial tension and moment demands result from the creation of, and gravity loading of, a "double-span" condition of the two joined beams located on either side of a failed or explosively removed or damaged column, which exerts tremendous tensile pull and vertical moment demand on the beam-to-beam joint connection across the failed or removed column, and adjacent beams-to-column joint connections located a beam span distance away. The joint connections of the present invention are best able to resist this condition.

Further, in the present invention the beams-to-column joint connections advantageously includes two improved or optimized gusset plates disposed on opposite sides of the beam and column and providing major elements of the improved joint connection, and connected to both of the beams and thus connect them together. The beam-to-beam connection provided by the improved or optimized gusset plates is sufficiently strong to greatly mitigate the damage from blasts, explosions, earthquakes, tornadoes and other violent disasters. The beams may be co-linear, somewhat angled with respect to each other, or even curved, as in the practice in constructing a curved facade for buildings.

In the present invention, as stated above, the gusset plates cover and protect the beams-to-column joint connections which attach one, or two, or more beams to a column. In broad view, the joint connections typically utilize an improved version of the gusset plates connection taught in U.S. Pat. No. 5,660,017, in which the gusset plates are not only welded to the beams (or cover plates on the beams, as the case may be), but, the gusset plates are also, welded directly, in a vertical direction, to the flange tips of the column by fillet welds, thus, creating through the gusset plates substantial moment-resisting connections. However, the present invention offers improvements in labor savings, in material costs, and in erection time requirements in comparison to the prior art.

It is therefore an object of this invention to provide an improved joint connection in a metal frame building in which adjacent joint connections are integrally connected by a substantially full-length beam assembly extending between and integrally welded into and forming a part of each of the interconnected joint connections.

It is another object of this invention to provide an improved joint connection structure which includes a column assembly with side plates or gusset plated so arranged and positioned that stub beams are not needed, and that once adjacent pairs of such columns are set in a foundation, then full-length beam assemblies may be fitted into the portions of the joint connections carried by the column assemblies and welded in place.

Still another object of this invention is to provide a beam-to-beam connection across a column which mitigates the likelihood of progressive collapse of the entire building or similarly heavy structure, upon loss of support from the column; or loss of effective beams-to-column joint connections constructed using conventional prior joint connection technology.

It is another object of this invention to provide a beam-to-beam connection at a joint connection of beams to a column, which beam-to-beam connection and the beams can carry the gravity and other loads on the beams upon the loss of column support; or loss of beam-to-columns joint connection constructed using conventional prior joint connection technology.

It is another object of this invention to provide a full-length beam assembly for assembly into a joint connection as generally described above, which full-length beam assembly provides for its fitment between an adjacent pair of column assemblies and for welding into a unitary structure.

Further objects, features, capabilities and applications of the inventions herein will be apparent to those skilled in the art, from the following drawings and description or particularly preferred embodiments of the invention.

BRIEF DESCRIPTION OF THE DRAWING FIGURES

FIGS. 1, 2, and 3 are each diagrammatic elevation views of respective: two, three, and four story building frameworks; and each illustrates plural column assemblies and plural interconnecting full-length beam assemblies defining the indicated numbers of levels or floors of a building. These drawing Figures also diagrammatically illustrate beam (or beams)-to-column joint connections according to this invention which are further described herein below;

FIGS. 2A and 3A are more developed or detailed schematic elevation views of the building frameworks seen in FIGS. 2 and 3, respectively, and include an illustration of an erection methodology made possible by the present invention;

FIG. 4 provides a fragmentary view, partially in cross section, of a column assembly, including a column sandwiched by and welded to a pair of gusset plates (or side plates), with an intentionally introduced root gap being provided preparatory to the welds;

Figure 4:
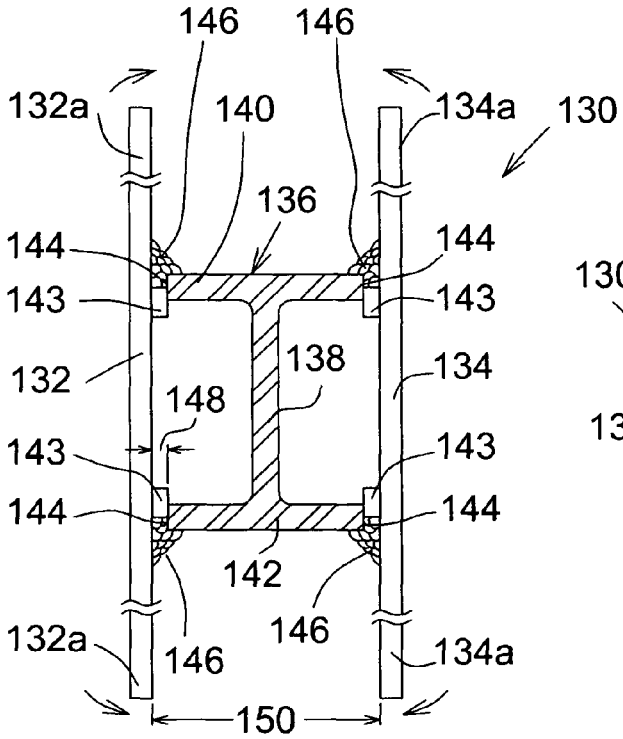
Figure 8:
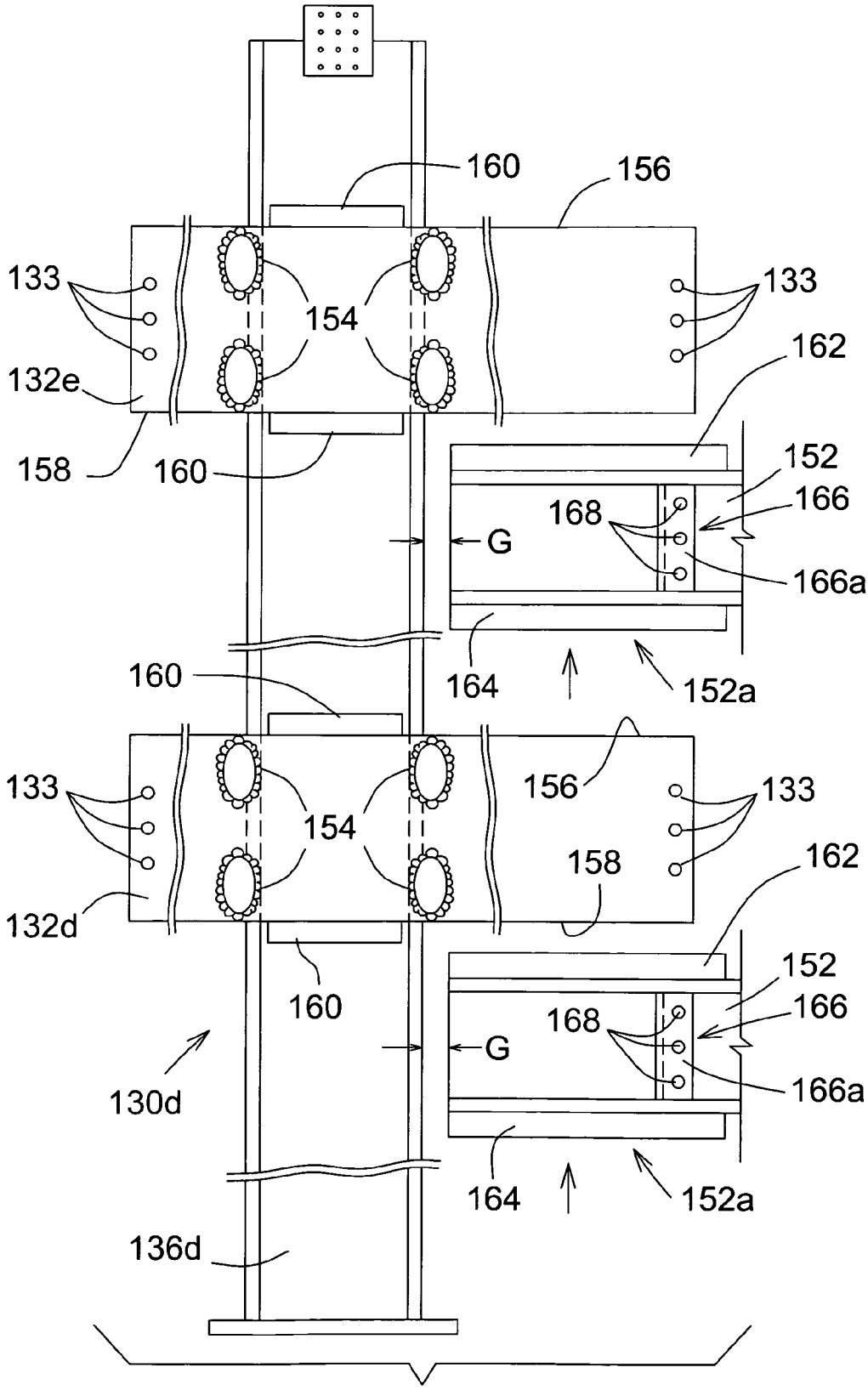
Figure 8A:
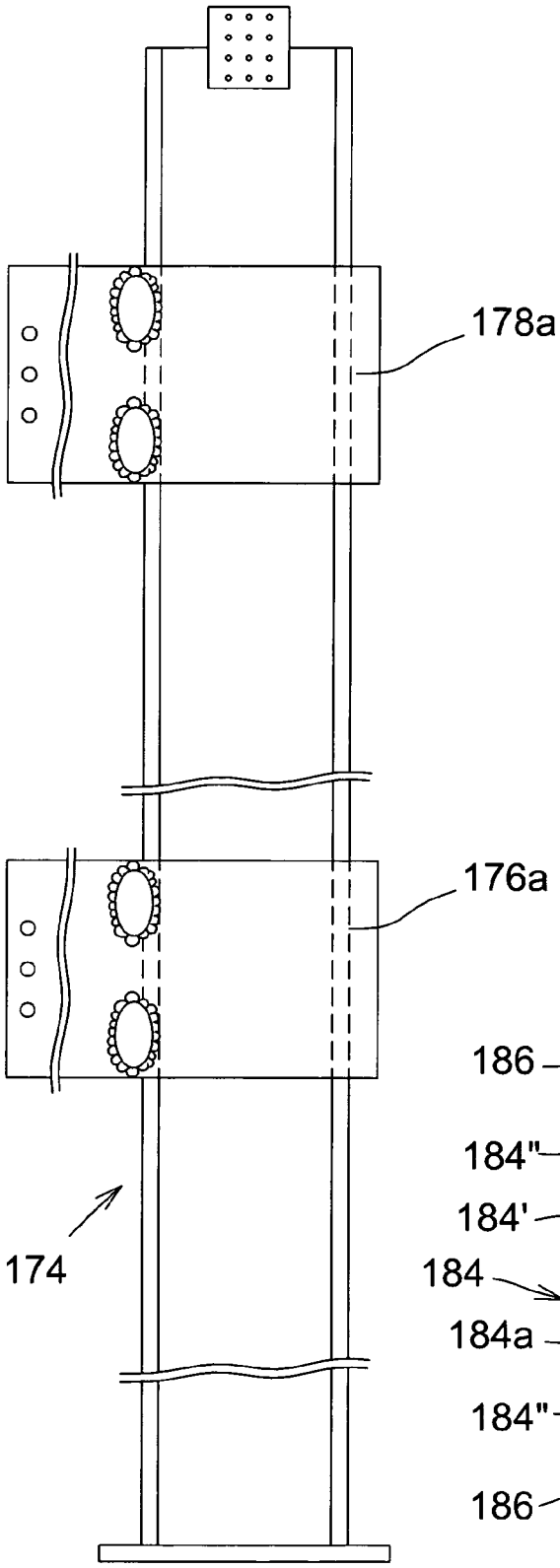
Figure 11:
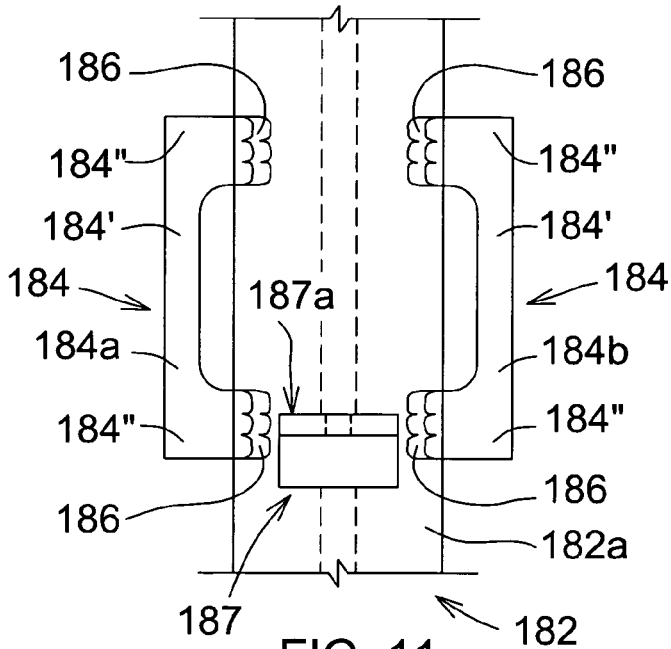
Figure 9:
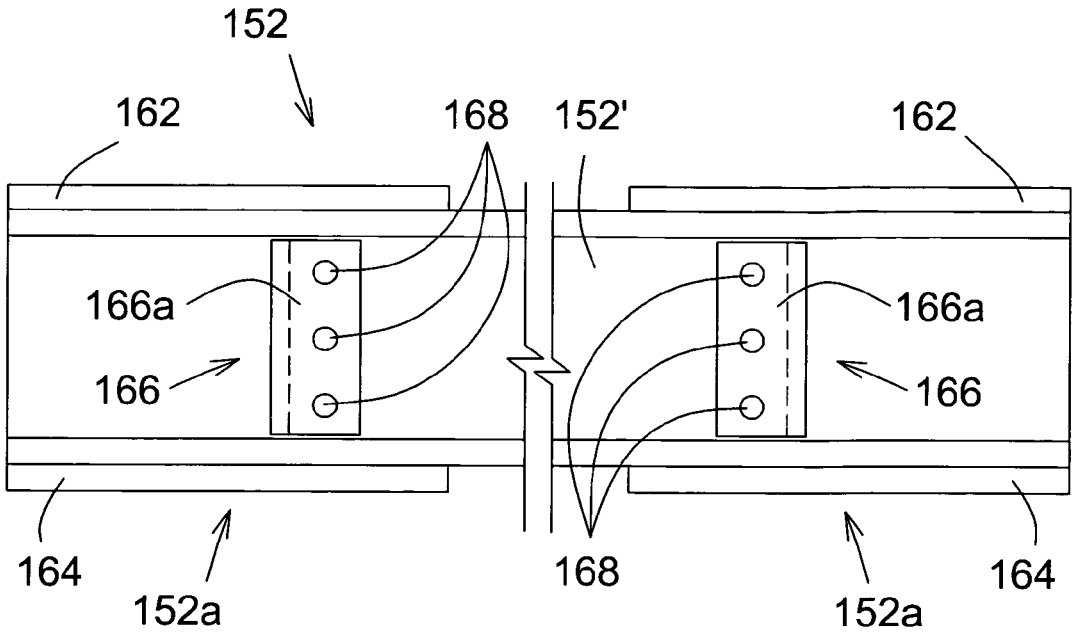
Figure 10:
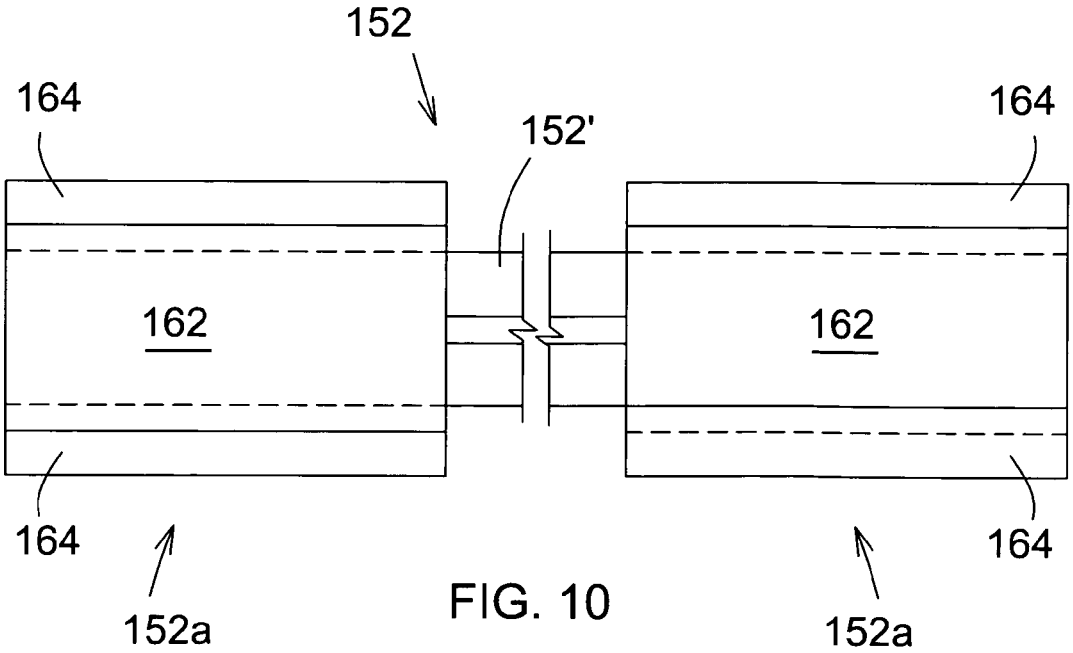
Figure 12:
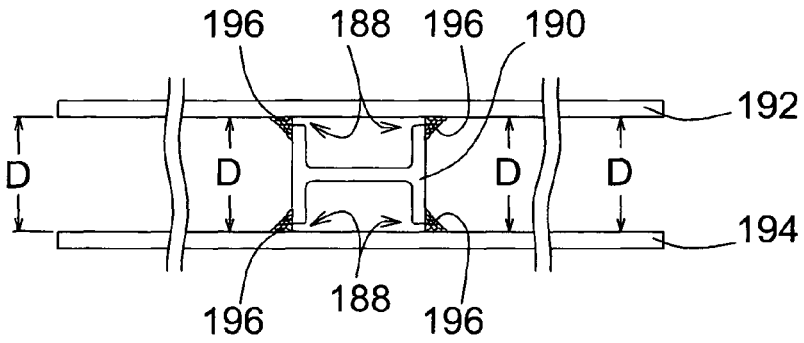
Figure 13:
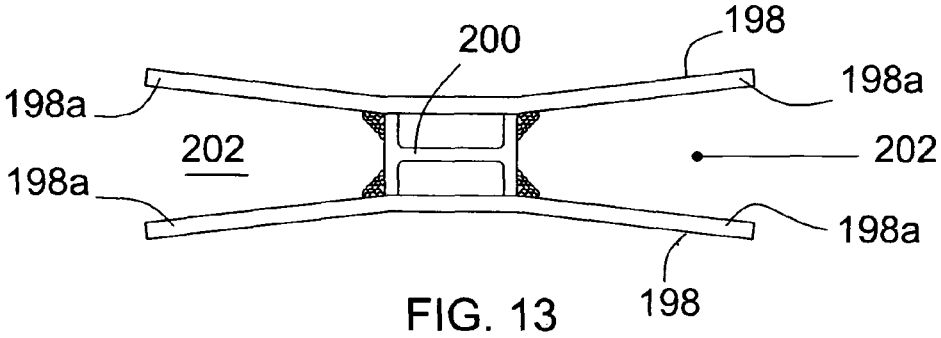
Figure 14:
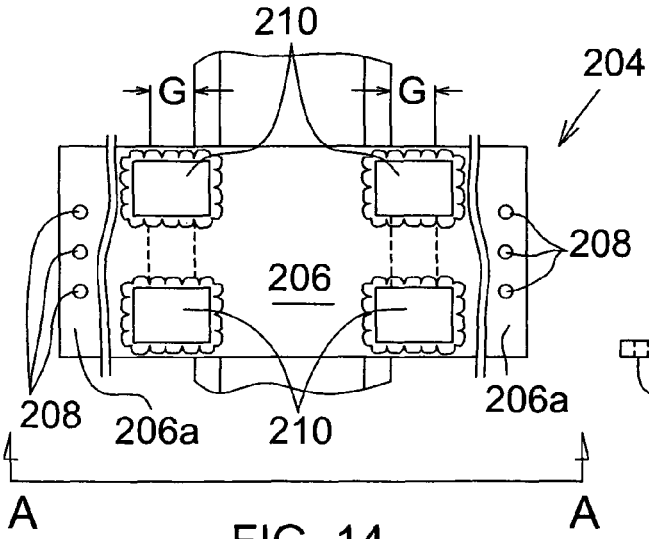
Figure 14A:
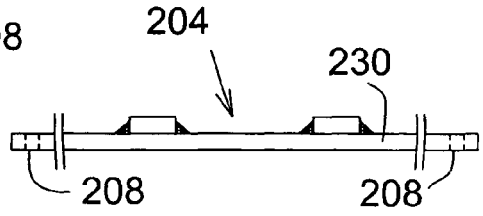
Figure 15:
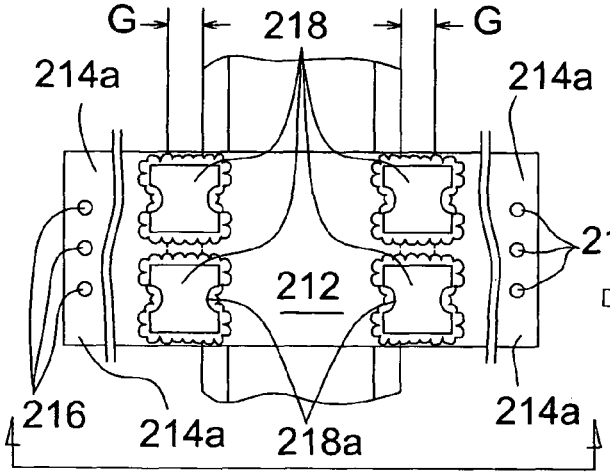
Figure 15A:
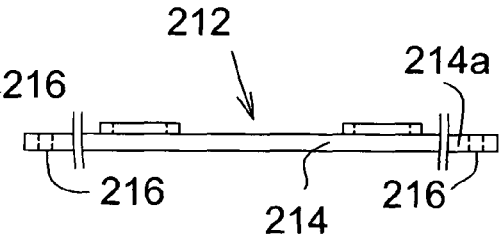
Figure 16:
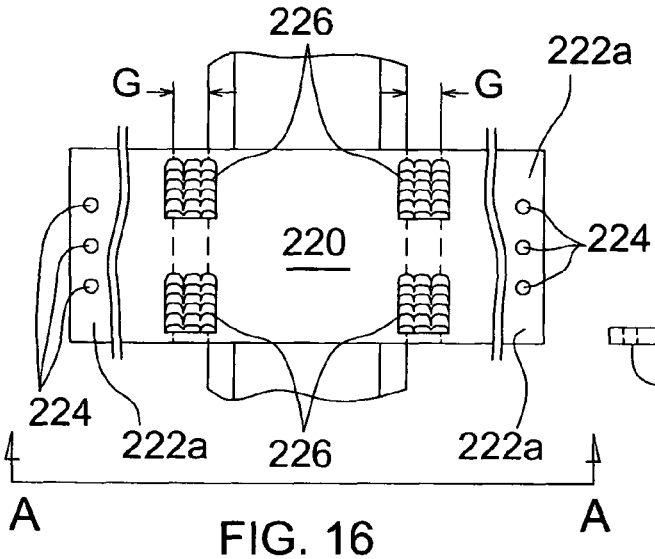
Figure 16A:
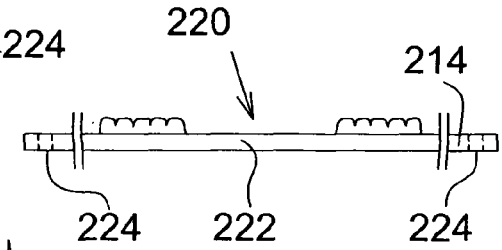
Figure 17:
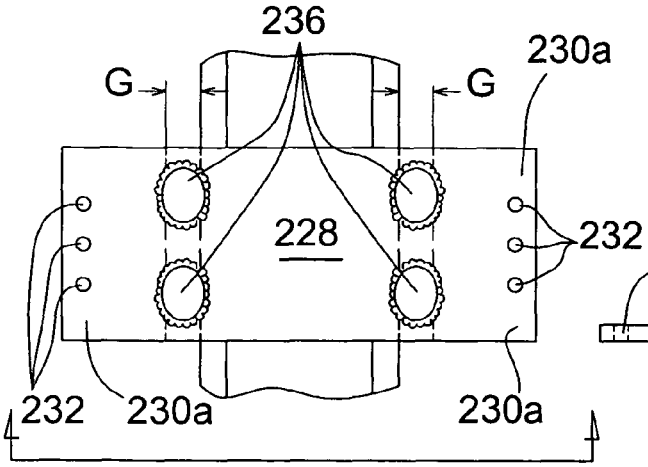
Figure 17A:
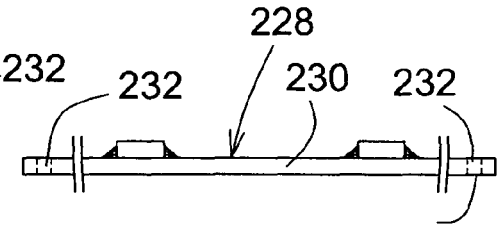
Figure 18:
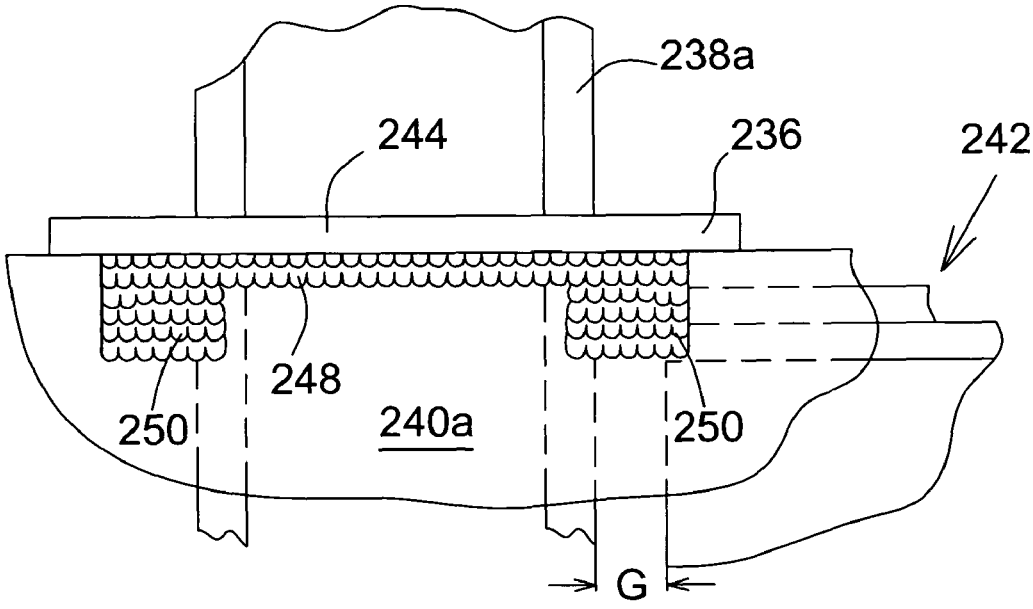
Figure 18A:
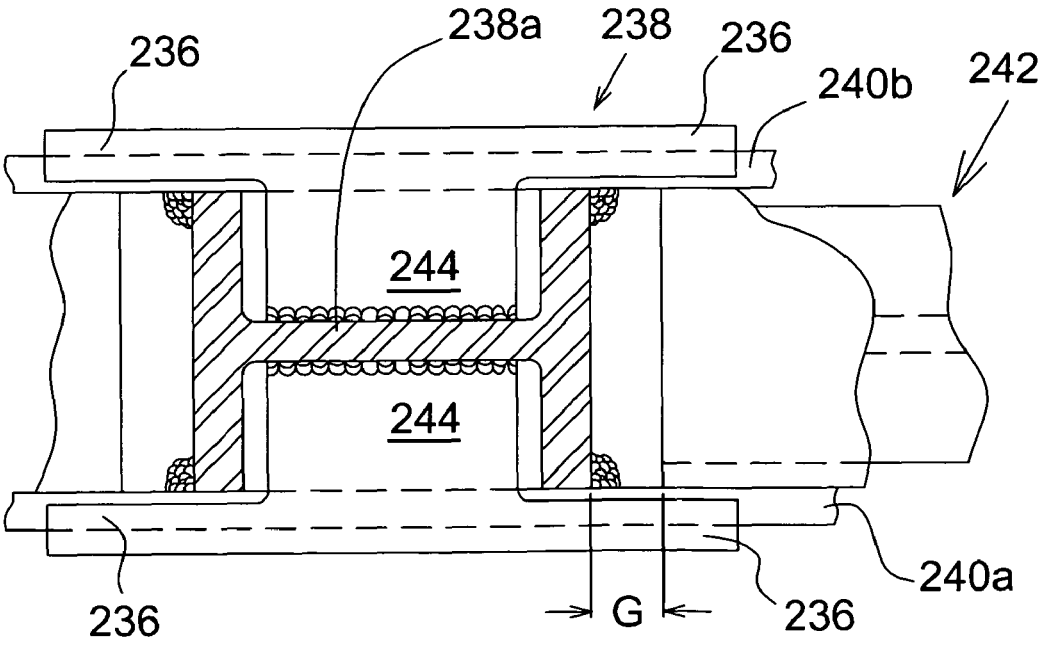
Figure 19:
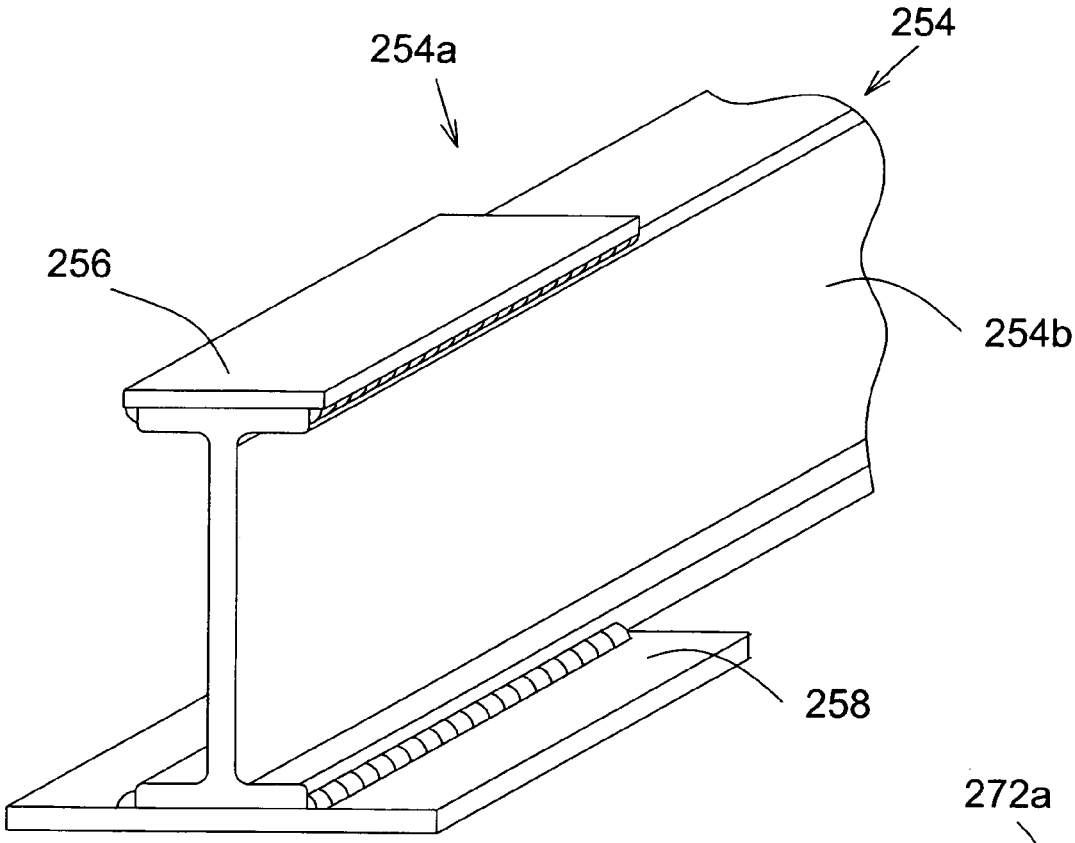
Figure 21:
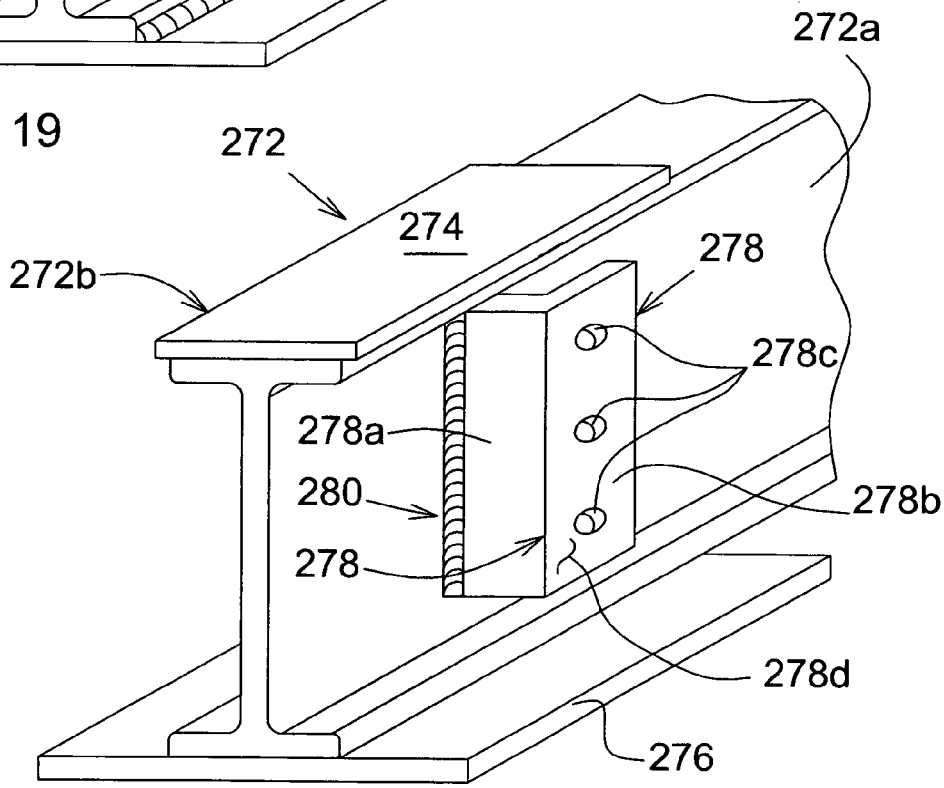
Figure 20:
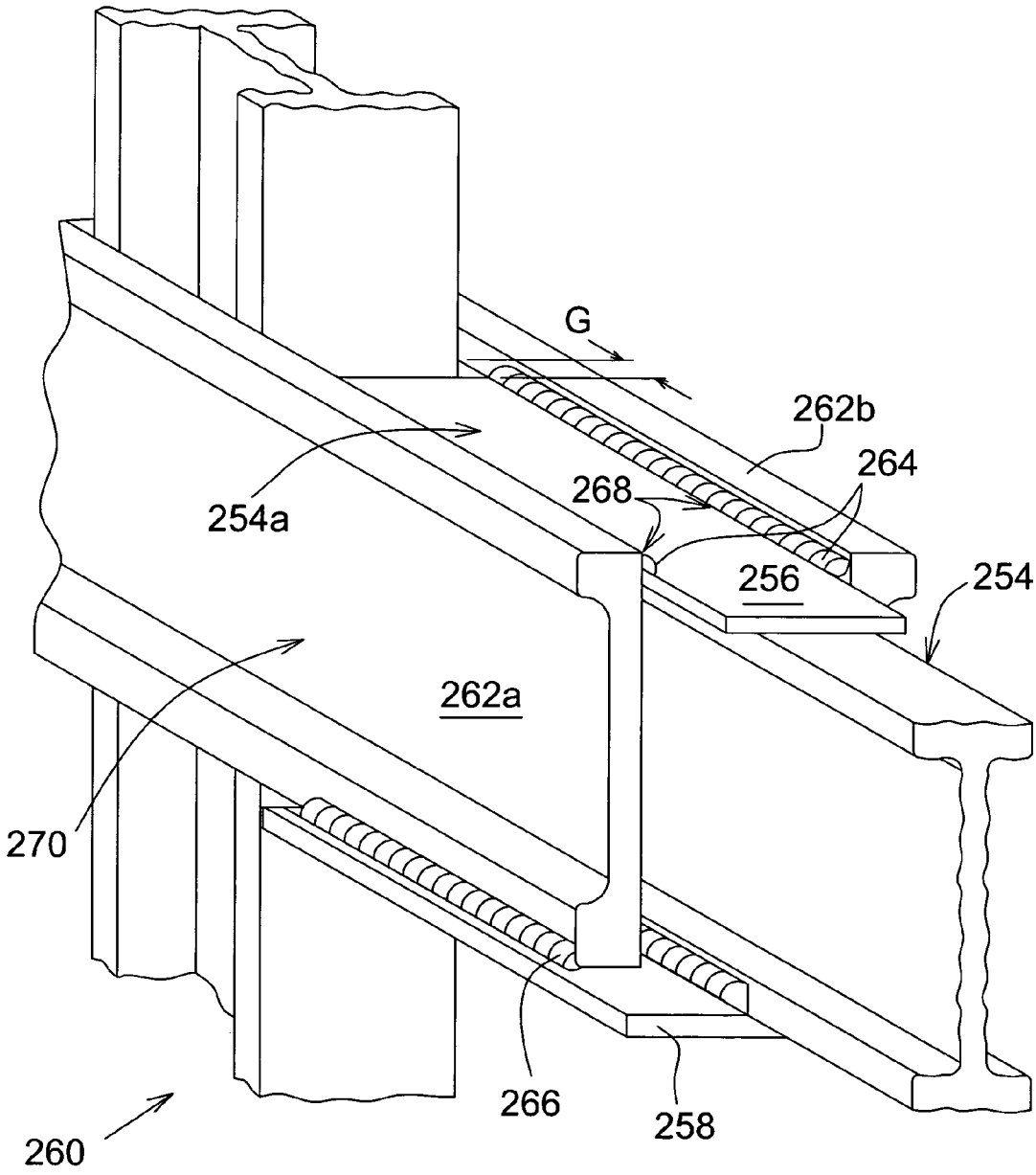

FIG. 8 provides an illustration of another embodiment of column assembly according to this invention, along with fragmentary illustration of end portions of two full-length beam assemblies which will be united with the column assembly by welding;

FIG. 8A provides an illustration of a column assembly similar to that seen in FIG. 8, except that this column assembly is single-sided, and is intended for construction of a corner or outside wall of a building structure;

FIG. 9 provides a side elevation view of an embodiment of a full-length beam assembly according to this invention, with part of the length of the beam broken out for clarity of illustration;

FIG. 10 illustrates a plan view of the full-length beam assembly seen in FIG. 9, and similarly has part of the length of the beam broken out for clarity of illustration;

FIG. 11 provides a fragmentary elevation view of an embodiment of column assembly with particularly configured side plates or gusset plates according to this invention;

FIG. 12 illustrates a fragmentary view of an embodiment of a column assembly similar to that of FIG. 4, with an intentional root gap introduced into the welded column assembly without the use of gap spacers;

FIG. 13 illustrates a fragmentary view of another embodiment of a column according to the present invention, and with a bending outwardly or flaring outwardly of the side plates or gusset plates introduced prior to and somewhat remaining after welding of the side plates to the column;

FIGS. 14 and 14A provide respective side elevation and longitudinal edge views of a particular gusset plate or side plate construction, which is a plate weldment construction;

FIGS. 15 and 15A provide respective side elevation and longitudinal edge views of an alternative construction of gusset plate or side plate, which is also a plate weldment construction according to this invention;

FIGS. 16 and 16A provide respective side elevation and longitudinal edge views of still another alternative construction of gusset plate or side plate, which is also a plate weldment construction according to this invention;

FIGS. 17 and 17A provide respective side elevation and longitudinal edge views of yet another alternative gusset plate or side plate construction, which is also a plate weldment construction according to this invention;

FIGS. 18 and 18A provide respective side elevation and fragmentary plan views of an alternative construction of column assembly in which a continuity plate is especially configured and placed to serve as a reinforcement of a side plate or gusset plate, along with a preferred configuration of weld bead at a gap location of the column assembly;

FIG. 19 provides a perspective or isometric view of an end portion of a full-length beam assembly according to one embodiment of this invention;

FIG. 20 provides a perspective or isometric view of an end portion of a full-length beam assembly like that seen in FIG. 19 during the process of joining (as by field welding) of the full-length beam assembly to a column assembly to form a beam-to-column joint assembly according to this invention;

FIG. 21 shows a perspective view of an end portion of yet another alternative embodiment of full-length beam assembly preparatory to uniting this beam assembly with a column assembly to form a beam-to-column joint.

Figure 22:
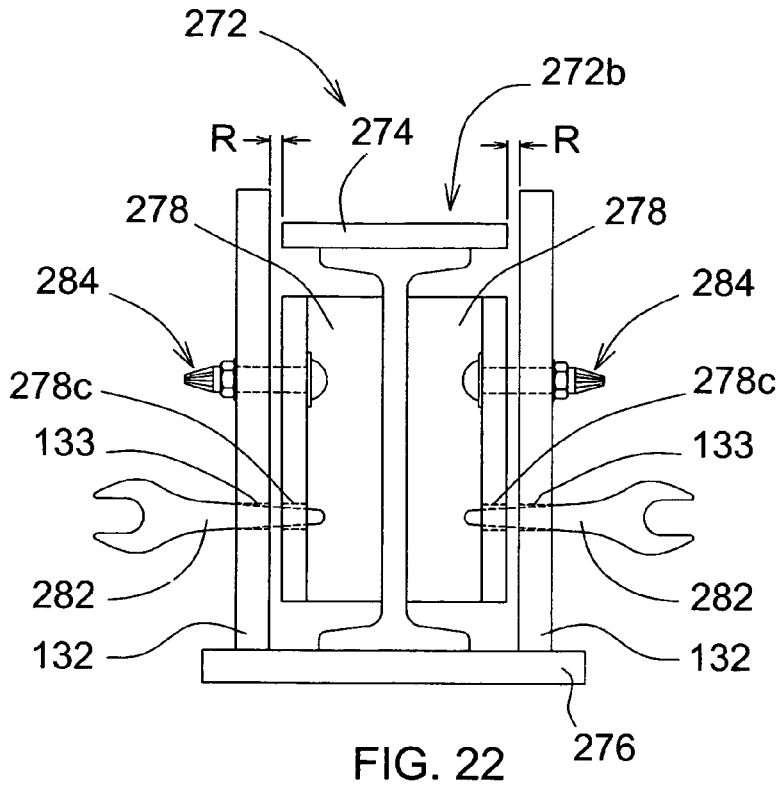
Figure 23:
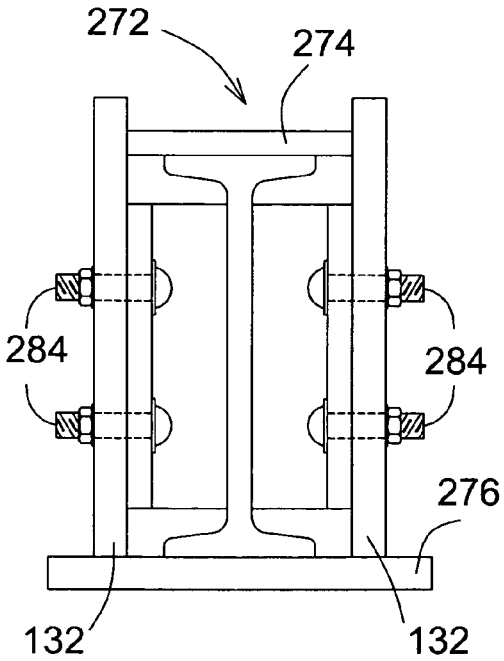
Figure 24:
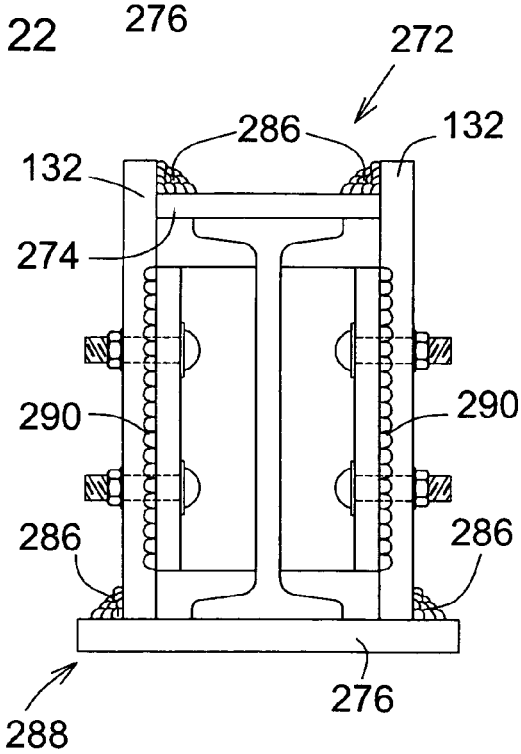

FIGS. 22-24 show sequential steps in the fitting of a full-length beam assembly to a column assembly, showing initial fit-up, bolting, and finished welding of the full-length beam assembly to a column assembly, forming a beam-to-column joint.

Figure 34:
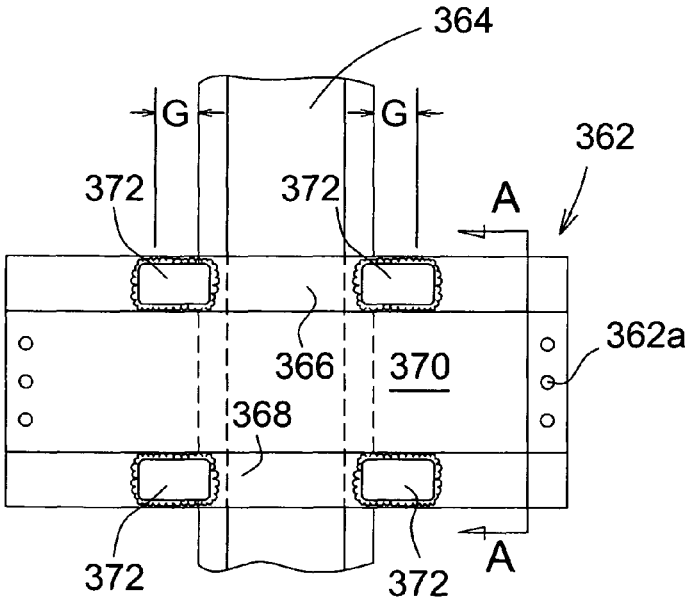
Figure 34A:
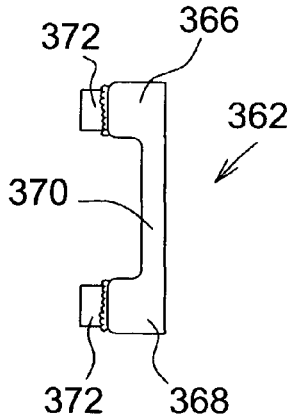
Figure 25:
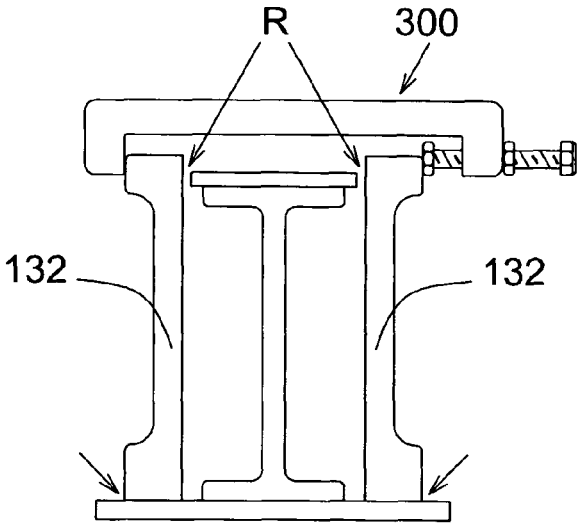
Figure 26:
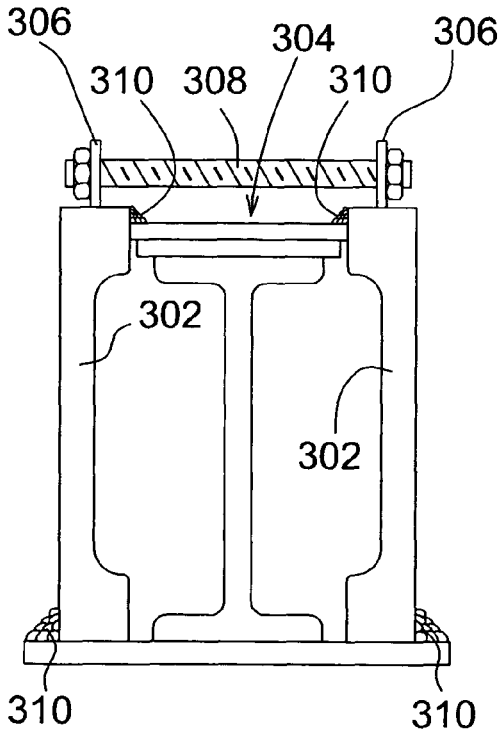
Figure 27:
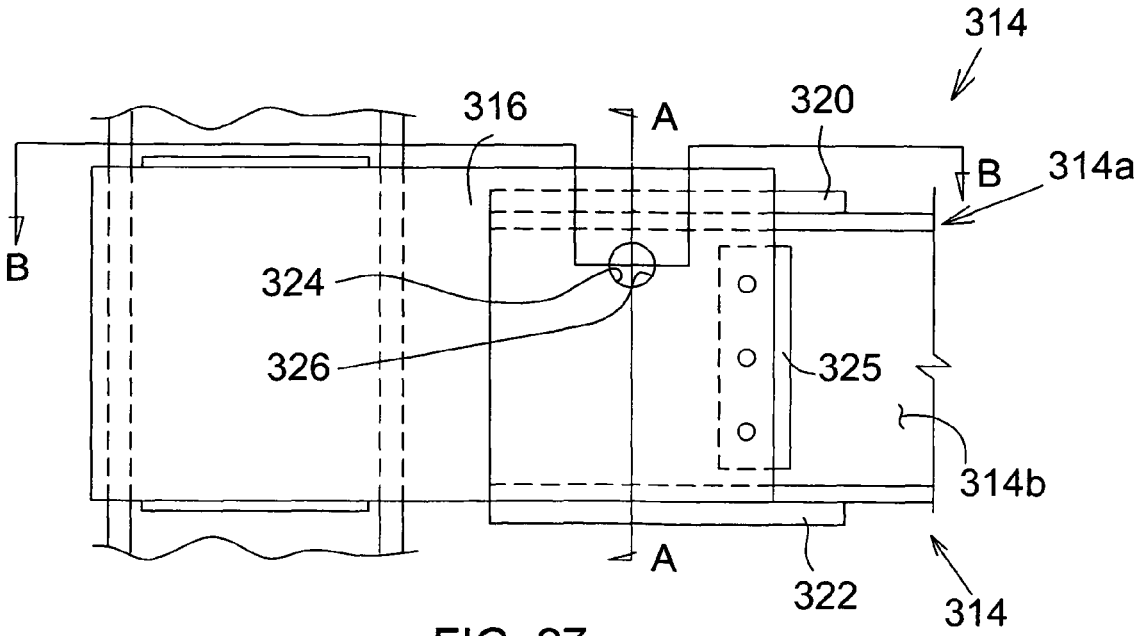
Figure 28:
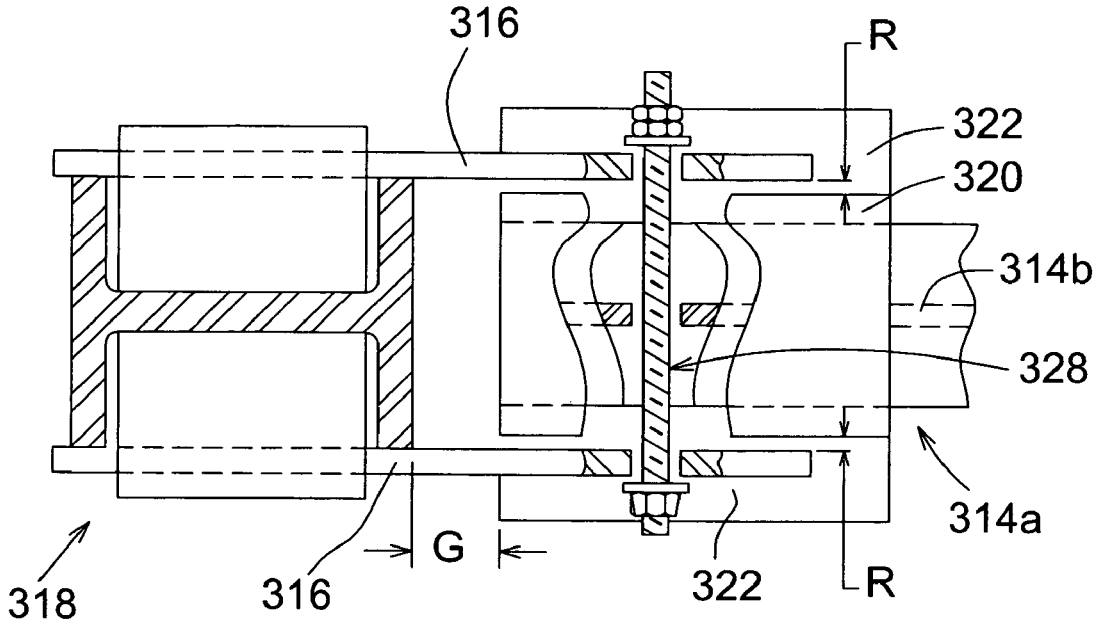
Figure 29:
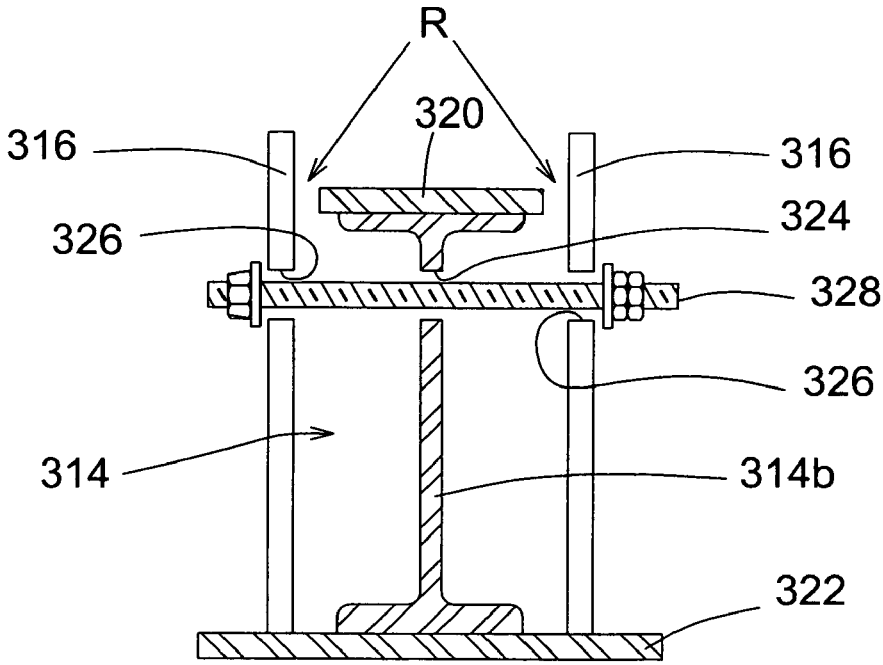
Figure 30:
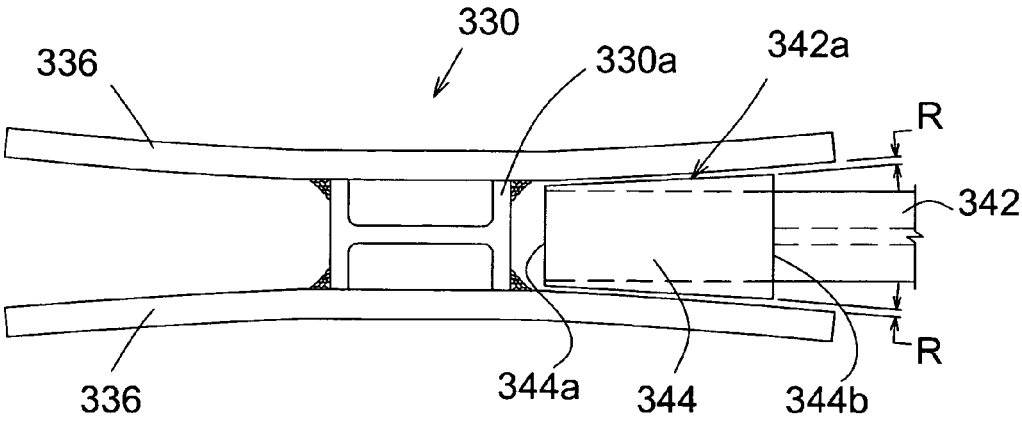
Figure 31:
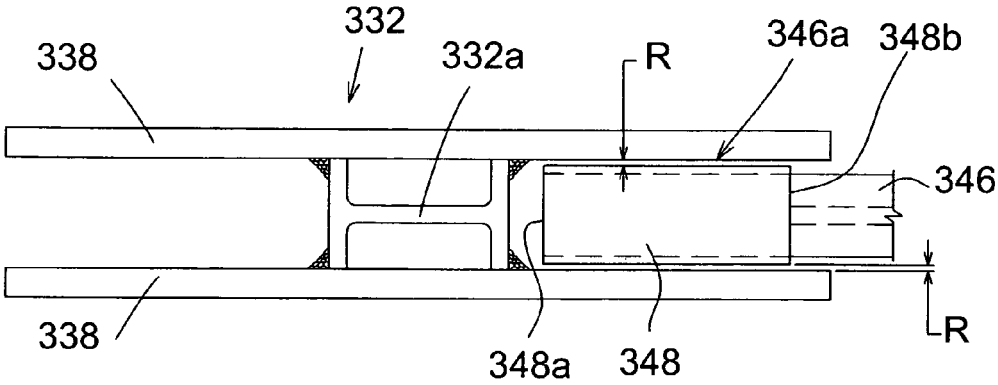
Figure 32:
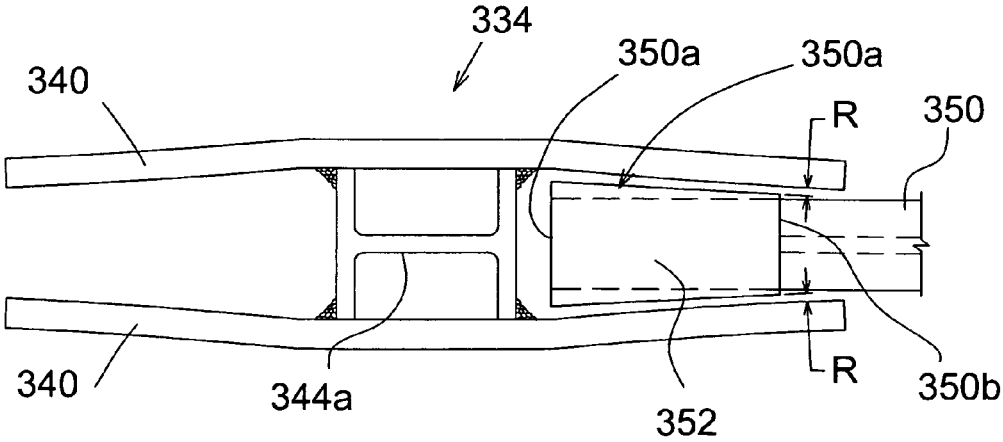
Figure 33:
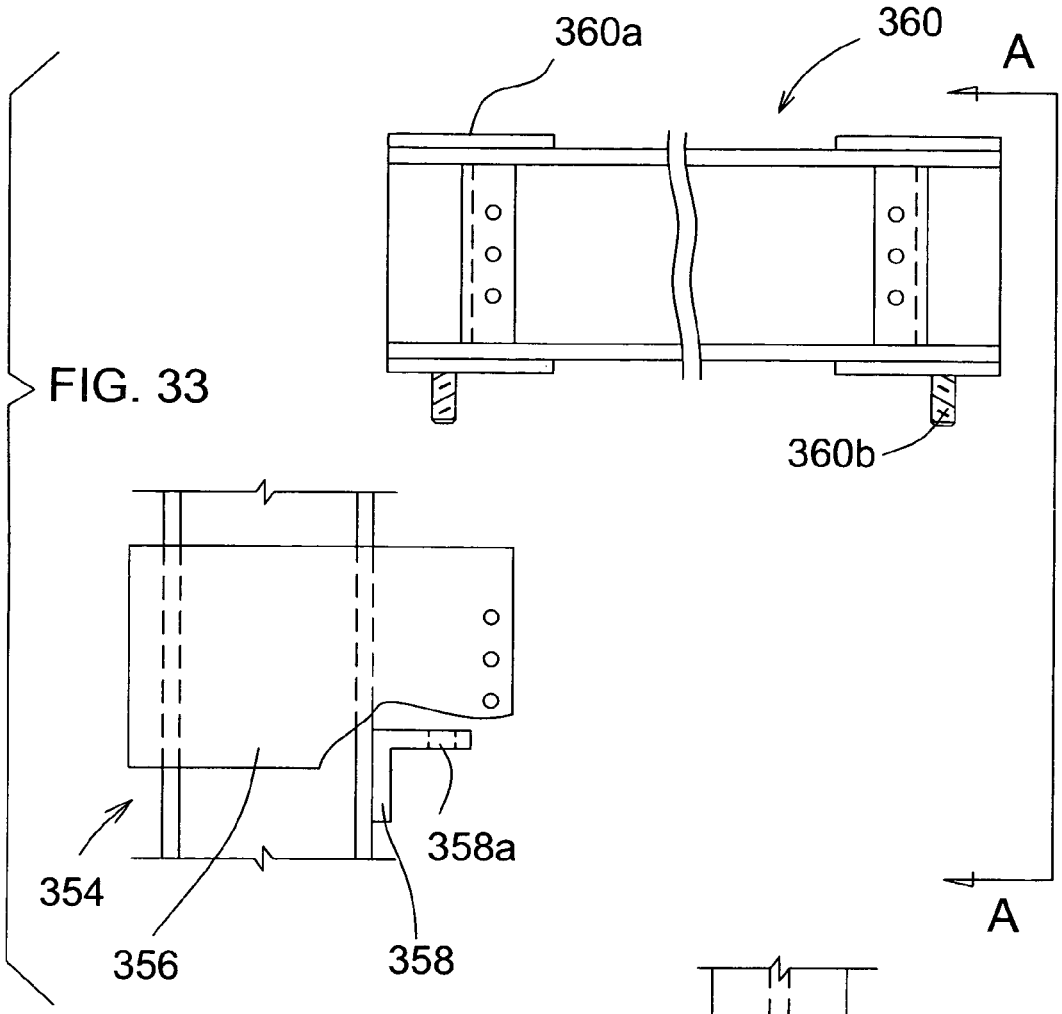
Figure 33A:
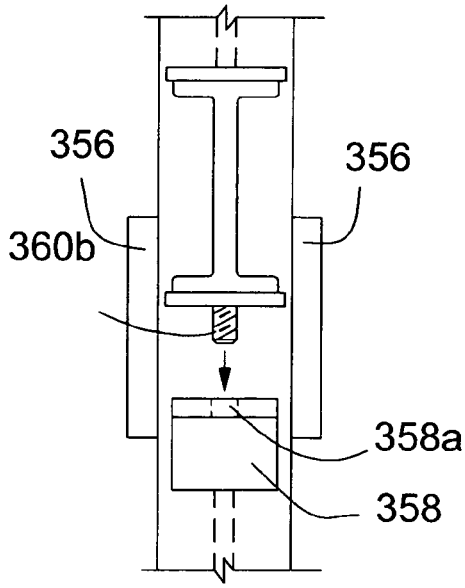

FIGS. 25 and 26, respectively provide diagrammatic illustrations of alternative embodiments of side plates of a column assembly and end portions of full-length beam assemblies, preparatory to and during the formation by welding of beam-to-column joint assemblies according to this invention;

FIGS. 27, 28, and 29 respectively provide diagrammatic side elevation, cross sectional, and plan views (the latter also being partially in cross sectional view) of a column assembly and an end portion of a full-length beam assembly according to another embodiment of the present invention, preparatory to the formation by welding of a beam-to-column joint assembly according to this invention;

FIGS. 30, 31, and 32 provide fragmentary diagrammatic plan views taken in cross section just above projecting pairs of side plates of column assemblies according to this invention, and preparatory to the uniting with these column assemblies of end portions of full-length beam assemblies showing other alternative embodiments of a beams-to-column joint connection according to this invention;

FIGS. 33 and 33A illustrate yet another alternative embodiment of the present invention, in which a column assembly includes a bracket or shelf for supporting an end portion full-length beam assembly, and the full-length beam assembly includes a stud or fitting for interlocking with this column assembly during erection and preparatory to welding of the full-length beam assembly and column assembly into a unitary whole; and FIGS. 34 and 34A diagrammatically depict yet another embodiment of a side plate construction according to this invention, which is particularly efficient in its use of steel or other material for construction of the side plate.

DETAILED DESCRIPTION OF EXEMPLARY PREFERRED EMBODIMENTS OF THE INVENTION

The structural steel commonly used in the steel frameworks of buildings is generally produced in conformance with steel ASTM standards A-36, A-572 and A-992 specifications. On the other hand, high strength aluminum and other high-strength metals might be found suitable for use in this invention under some circumstances. Thus, the invention is not limited to construction of steel frame buildings, but is applicable to construction of building frameworks from metals. It is also recognized that materials other than steel might be used for component parts of a beams-to-column joint according to this invention, particularly in the gusset plates or side plates and, possibly, in other elements of the joint connections. For example, in the gusset plates or side plates, other cross sectional shapes might be used in addition to those illustrated herein. So, the invention is not limited to the precise details of the embodiments shown and described herein.

Commonly shown in the drawings herein are fillet welds. However, the mention or illustration of a particular kind of weld herein does not preclude the possibility of other kinds of welds being found suitable by a person skilled in the art, including full-penetration and partial penetration single bevel groove welds. In a particular application, it might well be found suitable to use partial-penetration groove welds, flare-bevel groove welds and even other welds and forms of welding, which will be familiar to those ordinarily skilled in the pertinent arts.

Also, this invention is not limited to a particular configuration of or shape of beams and columns. Other shapes of columns or beams may be found suitable and capable of applying the inventions herein described, such as square or rectangular structural tube and box built-up shapes.

Figure 1:
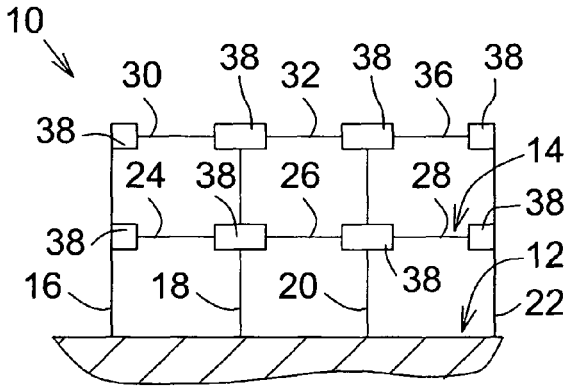

In broad overview, FIG. 1 provides a fragmentary diagrammatic front elevation view of a framework 10 for a building. The framework is three dimensional although the front elevation view does not illustrate this fact. In this instance, the framework 10 provides for a ground floor 12, and a second floor 14. This framework or building structure includes plural column assemblies 16, 18, 20, and 22 each embedded into or supported upon a foundation (not seen in the drawing Figures but indicated as a ground plane). Extending between adjacent column assemblies are plural full-length beam assemblies 24-36 for supporting the second floor and roof of the building. Joining the column assemblies 16-22 and full-length beam assemblies 24-36 are plural beam-to-column joint assemblies according to this invention (each indicated with the numeral 38), which upon completion of field-welding operations (to be described) become integral parts of and integrally join the column assemblies and full-length beam assemblies into a unitary whole. Again, although FIG. 1 is shown only in front elevation view, it is to be understood that the structure of building framework 10 is three-dimensional (i.e., extending away from the viewer into the plane of the drawing Figure) and the un-seen remainder of the building structure is similarly constructed.

Figure 2A:
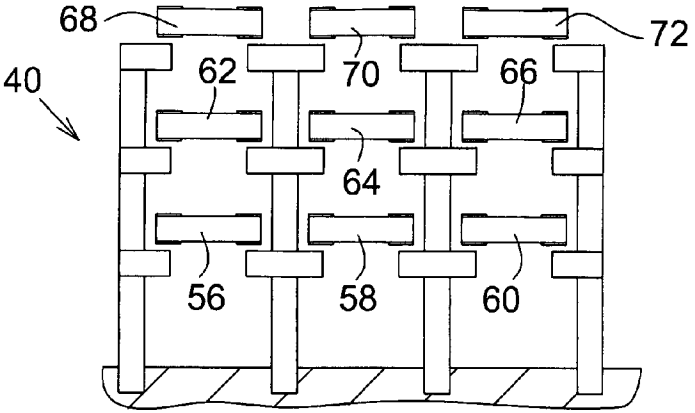
Figure 2:
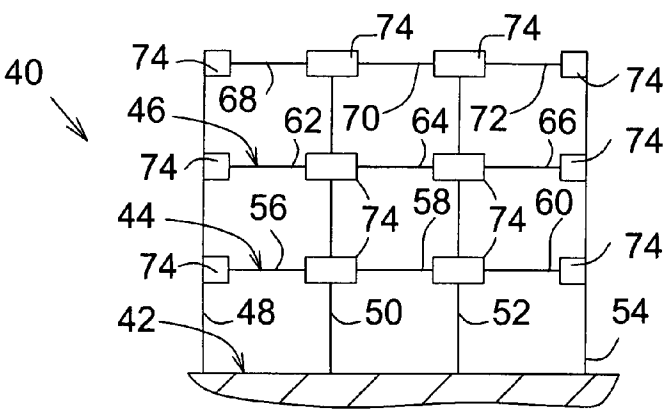

In similar broad overview, FIG. 2 provides a fragmentary diagrammatic front elevation view of a framework 40 for a building. In this instance, the framework 40 provides for a ground floor 42, a second floor 44, and a third floor 46. This framework or building structure 40 includes plural column assemblies 48, 50, 52, and 54 each embedded into or supported upon a foundation (not seen in the drawing Figures—but indicated by a ground plane). Extending between adjacent column assemblies are plural full-length beam assemblies 56-72 for supporting the second floor, third floor, and roof of the building. Joining the column assemblies 48-54 and full-length beam assemblies 56-72 are plural beam-to-column joint assemblies according to this invention (each indicated with the numeral 74), which upon completion of field-welding operations (to be described) become integral parts of and integrally join the full-length beam assemblies and column assemblies into an integral whole. Again, although shown only in front elevation view, it is to be understood that the structure of FIG. 2 is three-dimensional and the remainder of the structure is similarly constructed.

Figure 3A:
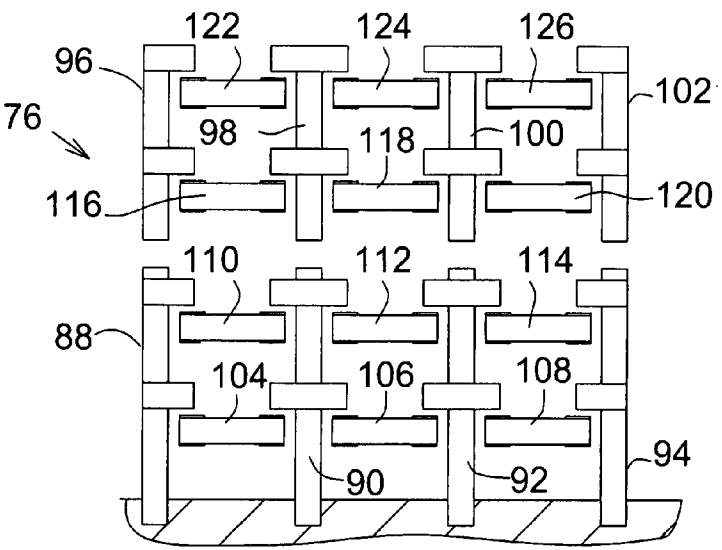
Figure 3:
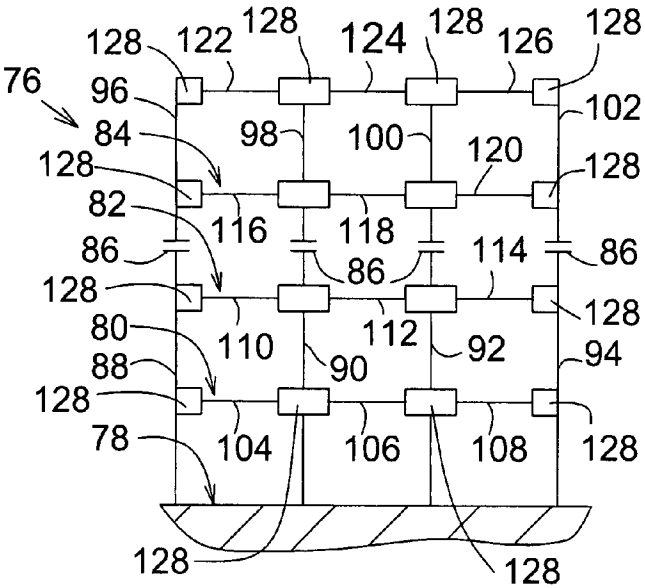

FIG. 3 similarly provides a fragmentary diagrammatic front elevation view of a framework 76 for a building. In this instance, the framework 76 provides for a ground floor 78, a second floor 80, a third floor 82, and a fourth floor 84. Upon consideration of FIG. 3A it will be noted immediately that because the column assemblies of this embodiment are perhaps too long to be shipped in their full length to a construction site, or too heavy to be moved about the construction site within crane limitations if they were full length, these column assemblies are each made of two pieces, and are field-welded together as is indicated at column joints 86.

This framework or building structure 76, viewing FIG. 3, includes plural column assemblies 88-94 at the lower level, and 96-102 at the upper level, with the upper level resting upon and being joined at field-welded column joints 86 to the lower level. Further, the column assemblies 88-94 of the lower level are each embedded into or supported upon a foundation (again not seen in the drawing Figures—but indicated by a ground plane). In the diagrammatic illustration of FIG. 3, the field welds to make column joints 86 have already been completed. And, extending between adjacent column assemblies 88-102 are plural full-length beam assemblies 104-126 for supporting the second, third, and fourth floors, and roof of the building to be finished on framework 76. Joining the column assemblies 88-102 and full-length beam assemblies 104-126 are plural beam-to-column joint assemblies according to this invention (each indicated with the numeral 128), which upon completion of field-welding operations to be described become integral parts of and integrally join the full-length beam assemblies and the column assemblies. Again, although shown only in front elevation view, it is to be understood that the structure of FIG. 3 is three-dimensional and the remainder of the structure is similarly constructed.

FIGS. 2A and 3A diagrammatically illustrate a methodology for fitting full-length beam assemblies between pre-set (i.e., substantially immovable) column assemblies, preparatory to making the field welds which unite these full-length beam assemblies with the column assemblies to define and form the beam-to-column joints described above. In the case of FIG. 2, it is seen that the column assemblies have been set at their design locations and alignments into a foundation for the building. Again, FIGS. 2A and 3A illustrate an erection or construction methodology utilized in placing full-length beam assemblies between placed or set column assemblies according to this invention. It will be noted in the following description that in each case, the full-length beam assemblies are moved into an alignment between column assemblies to be connected, and then are moved vertically relatively to the column assemblies either upwardly or downwardly to engage the full-length beam assemblies with the column assemblies preparatory to field welding that will permanently unite these assemblies into unitary structures defining beam-to-column joints according to this invention. Further, it is to be noted that these column assemblies include side plates (or gusset plates) extending toward next-adjacent column assemblies. And again, the gusset plates (or side plates) are referred to with either term (or with both terms) as one term has to do with the function of the plates as reinforcement or strengthening for a beam-to-column joint, and the other term has to do with the location of the plates on the sides of the columns and beams. But, at the time the column assemblies are set on a building foundation, or on a lower level of column assemblies, the column assemblies are not yet interconnected by full-length beam assemblies. And, because the beam assemblies are full-length (i.e., stub beams are not employed as parts of the beam-to-column joint assemblies), these full-length beam assemblies are too long to be moved horizontally between the column assemblies at the level of the extending side plates or gusset plates which will form parts of beam-to-column joints, as described above.

However, the full-length beam assemblies can be moved horizontally between the column assemblies at levels above or below the projecting gusset plates or side plates (as will be explained), and can then be lowered or raised into position with their opposite end portions received or sandwiched between the extending and spaced apart gusset plates or side plates. One way of picturing this operation is to imagine the extending side plates as jaws between which the end portions of full-length beams are moved vertically in preparation to being united by field-welding operations. FIG. 3A illustrates that in that particular embodiment of the invention, the full-length beam assemblies are each positioned at a level above the projecting side plates or gusset plates, and are then lowered downwardly into place, as is to be further described, preparatory to the field welding which will complete the beam-to-column joints. Also, as will be further described, the column assemblies my include a bracket or shelf upon which the end portions of the full-length beams may set preparatory to welding of the beam-to-column joint assemblies.

Similarly, FIG. 3A illustrates that the column assemblies 88-94 for the ground floor and for the second and third floors as well, have been set into place and aligned on the building foundation. Again, these column assemblies include side plates or gusset plates extending toward next-adjacent column assemblies. But, the column assemblies are not yet interconnected by full-length beam assemblies 104-114. And again, because the beam assemblies are full-length (i.e., stub beams are not employed), they are too long to be moved horizontally between the column assemblies at the level of the projecting side plates or gusset plates which will form parts of beam-to-column joints, as described above. However, as is seen in FIG. 3A the full-length beam assemblies can be moved horizontally between the column assemblies at levels above or below the gusset plates or side plates, and then can be lowered or raised into position with their opposite end portions sandwiched between the extending gusset plates or side plates. FIG. 3A illustrates that in the illustrated embodiment of the invention, the full-length beam assemblies 104-126 are most preferably positioned at a level below the projecting side plates or gusset plates of the column assemblies, and are then raised upwardly into place between the side plates or gusset plates of the column assemblies, as is to be further described, preparatory to the field welding which will complete the beam-to-column joints.

As FIG. 3A also illustrates, the building frame 76 also includes a fourth floor and roof level of connecting full-length beams. The most preferred methodology or sequence of erection of this building frame is to erect the column assemblies and full-length beam assemblies (as was described immediately above) for the second and third floors, and then to erect on this base the column assemblies 96-102 for higher floors by making the field welds at column assembly joints 86. Next, the interconnecting (i.e., interconnecting the column assemblies) full-length beam assemblies for the higher floors are fitted into place, and the field welds for these higher floors are completed, uniting the framework 76 into a unitary whole. It will be understood that for building frameworks having a greater number of floors or levels, the methodology is simply extended upwardly for the additional floors or levels of the building framework.

That is, those ordinarily skilled in the pertinent arts will understand in view of FIGS. 3 and 3A, that the same methodology can be used for building frames of a greater number of levels or floors than are illustrated in the present drawing Figures. It will be noted that many of the beam-to-column joint connections provide for load transfer and connection among at least two full-length beam assemblies and a column assembly. On the other hand, joint connections at a building corner or at an outside face of the building, or at an interior location of a building 10, 40, or 76 may also be similar although they may connect together a differing disposition and number of full-length beam assemblies and a column assembly. A column assembly for such a outside wall or corner location of a building framework is described below.

In view of the above, it will be appreciated that in order to fit a full-length beam assembly between the projecting side plates or gusset plates of a set (i.e., essentially immovable) column assembly, it is necessary to have a certain amount of clearance both between the ends of the full-length beam assembly and the column assemblies, and between the end portion of the full-length beam assembly and the spaced apart side plates or gusset plates of the column assemblies to be interconnected. In other words, some working space or "rattle" space must exist for the construction personnel to fit parts into, and this is true both with respect to the length of the full-length beam assemblies and to the fitting of their end portions between projecting gusset plates (or side plates).

Stated differently again, there must be a gap to a column assembly in the length direction of a full length beam assembly. In fact, the present invention employs such a gap for structural reasons, so the term "full-length beam assembly" means a beam assembly with welded components that extends substantially from and between two adjacent column assemblies, and defines an end gap of only a few inches with respect to each column assembly. On the other hand, with respect to fitting the end portions of the full-length beam assemblies between the projecting side plates or gusset plates, there must be a certain amount of lateral "rattle" space into which the end portion of a full-length beam assembly can move (i.e., upwardly or downwardly as explained above) with at least some clearance in order to allow construction personnel to fit together the full-length beam assemblies to the set column assemblies preparatory to field welding of the beam-to-column joints.

Figure 5:
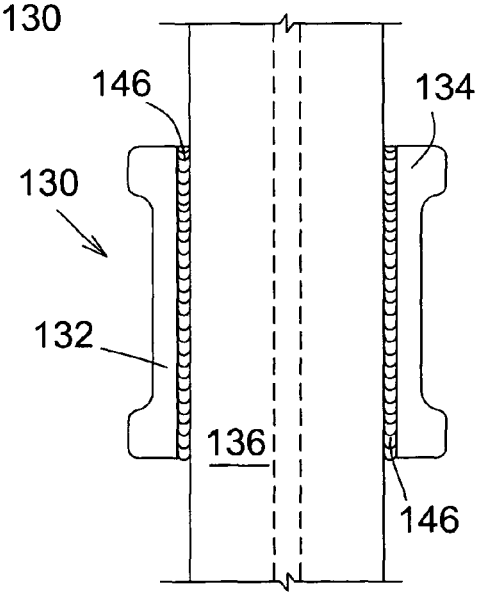
FIG. 5 is a fragmentary side elevation view of the column and side plates (or gusset plates) of the column assembly seen in FIG. 4 after completion of the welds.

FIG. 4 illustrates one embodiment of a column assembly 130 (seen in cross sectional plan view taken just above a pair of side plates 132, 134 (or gusset plates) for a beam-to-column joint connection). FIG. 5 illustrates a fragmentary elevation view of this same column assembly 130 looking toward the H-section column 136 and between the projecting side plates (or gusset plates) 132, 134. Viewing FIG. 4, it is seen that the H-section column 136 includes a central web 138 and a pair of spaced apart opposite flanges 140, 142. The flanges each have flange tips or end surfaces, indicated with the numerals 144. At these flange tips 144, the side plates or gusset plates 132, 134 are attached by welding, with the welding operation resulting in multi-pass weld beads 146. Those ordinarily skilled in the pertinent arts will understand that when the welds 146 are placed and cool, the weld metal contracts as it cools and tends to pull the outer ends 132*a*, 134*a* of the side plates (or gusset plates) 132, 134 toward one another, as is indicated by arrows on FIG. 4. Depending on the skill of the welder and variables in dimensions for the column 136, it would be possible for this "weld pulling" to influence or change the spacing between the side plates 132, 134 (i.e., moving or pulling the side plates toward one another) to result in a spacing 150 between these side plates at their out ends which is too small to accept an end portion of a full-length beam assembly during erection of a building frame at a construction site.

In order to offset this effect described above, and insure sufficient "rattle" room between the side plates 132, 134 all along their projecting length, the present invention according to one embodiment utilizes an intentionally introduced or created root gap between the tips of the column flanges 140, 142 and the side plates 132, 134 preparatory to welding. As is seen best in FIG. 4, a spacer item, such as a small spacer, steel block, or length of welding rod or wire 143 is inserted between each flange tip 144 and the side plate 132 or 134, creating a gap (or root gap) 148 illustrated on FIG. 4. This intentional root gap is not so large as to prevent the weld beads from spanning this gap. But, the root gap 148 does slightly space apart the side plates 132, 134 at their attachments to the column flange tips 144 by a dimension that slightly exceeds the width of the column 136. The result is that even if the outer ends of the side plates pull together as a result of the welding operation, there is still sufficient spacing 150 between these side plates at their outer ends that an end portion of a full-length beam assembly can be moved vertically (i.e., upwardly or downwardly) between these side plates during the building frame erection process.

Those ordinarily skilled in the pertinent arts will recognize that the spacers 143 may be certified structural material (such as certified welding rod or wire) in which case they may be left in place as seen in FIG. 4. On the other hand, a less expensive steel may also be used to make the spacers 143, and may be removed after the tacking of welds 146 is completed. Alternatively, the desired intentional root gap may be achieved by using a different expedient that does not use metal spacers interposed between surfaces to be welded. That is, a fixture, or holder may be used to space the column member and side plates preparatory to welding.

Figure 6:
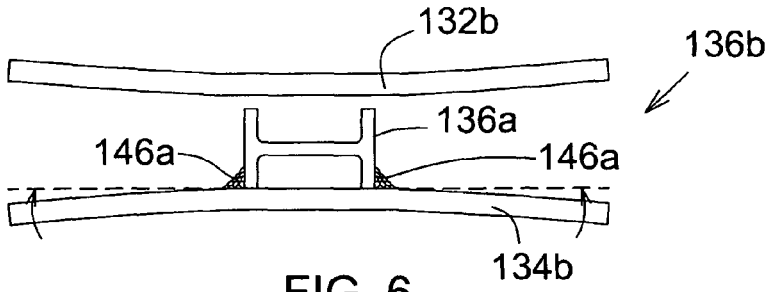
FIG. 6 illustrates a fragmentary view, partially in cross section, of a column welded to one of a pair of gusset plates (or side plates), and preparatory to placement and welding of the other of the pair of gusset plates (or side plates)
Figure 7:
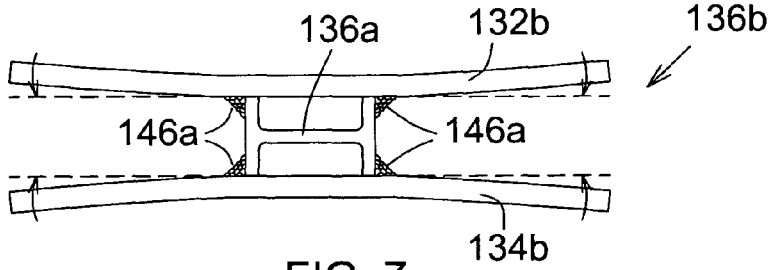
FIG. 7 illustrates the column and gusset plates (or side plates) seen in FIG. 6, but with the welding operations for each gusset plate (or side plate) completed, and illustrating resultant changes in alignment of the gusset plates (or side plates)

FIGS. 6 and 7 illustrate an alternative embodiment of the present invention, in which a different expedient is employed to make sure that there is sufficient "rattle" space between the outer ends of the spaced apart side plates after welding, so that an end portion of a full-length beam assembly can be fitted between these side plates.

FIG. 6 illustrates a column assembly 136*b* (seen in cross sectional plan view taken just above a pair of side plates 132*b*, 134*b* (or gusset plates) for a beam-to-column joint connection. This column assembly 136*b* includes an H-section column 136*a*. In FIG. 6 it will be noted that the upper (in this view) side plate 132*b* has not yet been welded into place, and that this side plate is not truly straight. That is, the end portions of the side plate have been displaced slightly out of plane, so that the side plate ends flare away from the opposite side plate 134*b*. However, the lower (in this view) side plate 134*b* has been completely welded (weld beads being illustrated at 146*a*) to the tips of the column flanges, recalling the description above. As a result, the previously slightly cambered or displaced side plate 134*b* has been pulled by cooling weld contraction forces into a position of being straight, or nearly so, as is indicated by arrows on FIG. 6.

FIG. 7 illustrates a cross sectional plan view like FIG. 6, but showing both the side plates 132*b* and 134*b* with completed welds uniting these side plates with the H-section column 136*a*. In solid lines are shown the pre-welding shapes and positions of the outer ends of the side plates 132*b*, 134*b*, while the dashed lines indicate the shapes and positions of the outer ends of these side plates after completion of the welds 146*a*. As is seen best in FIG. 7 the weld metal has contracted as it cools and pulls the outer ends of the side plates (or gusset plates) 132*b*, 134*b* toward one another. As a result, the side plates 132*b*, 134*b* are essentially parallel and equally spaced apart along their length. The end result is a spacing between these side plates at their out ends (and along their length from these outer ends to the column 136*a*) which provides sufficient "rattle" space or room (i.e., extra lateral space) between the side plates 132*b*, 134*b* all along their projecting length so that an end portion of a full-length beam assembly can be moved vertically (i.e., upwardly or downwardly) between these side plates during the building frame erection process.

FIG. 8 is an exploded elevation view, showing a column assembly 130*d* setting on and secured in place to a foundation or ground plane. Thus, the column assembly 130*d* should be considered to be essentially immovable. This column assembly 130*d* is configured for supporting the second and third floors (i.e., along with other similar column assemblies) of a building structure, and for addition on top of this column assembly of an additional column assembly (or assemblies) for still higher floors of a building framework. For this purpose, the column assembly 130*d* includes two vertically spaced apart pairs of side plates (or gusset plates), with only the side plate 132*d* and 132*e* closest to the viewer being visible in FIG. 8. The side plates 134*d* and 134*e* spaced away from the viewer are not visible in FIG. 8.

The column assembly 130*d* includes an H-section column 136*d* having a central web and opposite flanges (as described above) and to which the side plates are welded in spaced apart pairs (also as described above. However, the side plates 132*d* and 132*e* (and 134*d*, 134*e*) embody an alternative embodiment of the present invention, which is particularly efficient in its use of steel. That is, the side plates illustrated in FIG. 8 have an extraordinarily low steel utilization (i.e., a considerable material saving), and yet achieve outstanding strength and stiffness for a beam-to-column (or beams-to-column) joint connection, as is further explained below. As a first consideration, it is to be noted that the side plates 132*d* and 132*e* (and 134*d*, 134*e*) are essentially fabricated of comparatively thin, flat plate construction requiring considerably less steel to make than would be taught by the conventional technology, and that only at the most highly stressed locations (as will be explained) are these rather thin flat plates reinforced by addition of (in this case) localized, welded-on reinforcing features, such as lugs, plate members, bars, or surface applied weld metal (further disclosed below).

As a predicate to understanding the advantages of the side plate constructions seen in FIG. 8, it is to be noted that end portions (each indicated with the numeral 152*a*) of full length beam assemblies 152, are each seen in the positions these beam assemblies will occupy preparatory to their being lifted vertically upward so that the end portion 152*a* is received between the projecting side plates 132*d*, 134*d* (or between plates 132*e*, 134*e*) of the column assembly. Those ordinarily skilled in the pertinent arts will recognize that the full length beam assemblies 152 (further described below with reference to FIGS. 9 and 10) have end portions 152*a* at each of their opposite ends, and also have a length just slightly less than the spacing distance between the column members of the column assemblies which these full-length beam assemblies will interconnect. As a result, the full-length beam assemblies define a slight gap "G" with each column member.

Giving further attention to FIG. 8, it is seen that the side plates 132*d*, 134*d* (and 132*e*, 134*e*) each have a number of (in this case, three) through holes 133 aligned generally vertically and located near the outer or distal ends of these side plates. Also, the side plates 132*d*, 132*e* each have two vertically aligned pairs of reinforcing members 154. These reinforcing members are disposed generally near the top and bottom edges (156, 158) of the side plates 132*d*, 132*e*, and span across the gap "G." The column assembly 130*d* also includes vertically spaced apart pairs of continuity plates 160 (or horizontal shear plates) which are welded to the web of the H-section column member, and into the space between the flanges of this H-section column member 136*d*. These continuity plates are welded to the column web, and are optionally welded as well to the column flanges. The continuity plates 160 are also welded to the side plates 132*d*, 132*e*.

As is seen in FIG. 8 at the right-hand side, and as is also seen in FIGS. 9 and 10, the full-length beam assemblies 152 have a beam portion 152', and a pair of opposite end portions 152*a*. The beam portion 152' generally is a hot-rolled steel structural member, most preferably of I-beam configuration (although the invention is not so limited), and may have a depth of about 18 inches to about 44 inches or more, and a width of from about 6 inches to 16 inches, or more. Accordingly, it will be appreciated that the drawing Figures are not to scale, and that in several Figures length or proportion of parts and components has been reduced or rearranged for clarity and ease of illustration. Each end portion 152*a* includes an elongate cover plate 162 welded to the upper flange of the beam 152', and another elongate cover plate 164 similarly welded to the lower flange of the beam 152'. In addition, on each side of the end portion 152*a*, the beam assembly 152 includes a pair of brackets, indicated with the numeral 166, only the one of which is on the side facing the viewer is visible in FIGS. 8 and 9. This bracket 166 may be L-shaped as illustrated, although the invention is not so limited.

As is indicated in FIGS. 8 and 9, the bracket 166 includes a leg or side 166*a*, which is generally coextensive in a vertical alignment at its outer face with a corresponding side edge of one or both of the cover plates 162, 164. This bracket leg 166*a* also has a number of (three in this case) vertically spaced holes 168, which align with the holes 133 of the side plates 132(*d* & *e*), 134(*d* & *e*) when the end portion 152*a* is placed between these side plates. As will be explained, at that stage of the erection process, temporary support members will be placed into the holes 133, 168 so that the full-length beam assembly 152 is supported between the aligned columns by the projecting side plates.

FIG. 8A provides a fragmentary side elevation view of a column assembly 174 which is similar in many respects to that seen in FIG. 8, except that the column assembly 174 is for installation at an outside wall (i.e., outside face) or corner of a building framework, or at the end of an exterior or interior building framework. For this reason, the side plates of the column assembly seen in FIG. 8A extend only in a single direction from the column, although they span across the horizontal dimension of the column itself and sandwich this column between the welded-on side plates. Viewing FIG. 8A, it is seen that this column assembly 174 is configured for supporting the second and third floors (i.e., along with other similar column assemblies) of a building structure, and for addition on top of this column assembly of an additional column assembly (or assemblies) for still higher floors of a building framework. For this purpose, the column assembly 174 includes two vertically spaced apart pairs of side plates (or gusset plates), with only the side plate 176*a* and 178*a* closest to the viewer being visible in FIG. 8A. The side plates 176*b* and 178*b* spaced away from the viewer are not visible in FIG. 8. This column assembly 174 (like column assembly 130*d* of FIG. 8) includes an H-section column 180 having a central web and opposite flanges (as described above) and to which the side plates are welded in spaced apart pairs (also as described above. Also similarly to that illustrated in FIG. 8, the side plates 176*a* and 176*b* (and 178*a*, 178*b*) embody the alternative embodiment of the present invention seen in FIG.

8. So, it is to be understood that plural column assemblies of FIG. 8 and of FIG. 8A could be employed together in a building framework to mutually support full-length beam assemblies extending between and joined by welding to these column assemblies. Again, the side plates 176, 178 are essentially or can be fabricated as comparatively thin, flat plate constructions requiring considerably less steel to make than would be taught by the conventional technology.

Turning now to FIG. 11, a fragmentary side elevation view is provided of an alternative embodiment of column assembly 182 and side plate 184 configuration. As seen in FIG. 11, the column assembly 182 includes a column member 182*a* which is of the now-familiar H-section configuration. However, the side plates 184*a*, 184*b* are each of a configuration which in section (or end elevation view) as seen in FIG. 11, is of a shallow U-shape. Each side plate 184 includes a rather or comparatively thin central section 184' and an upper and lower thicker section, each indicated with the numeral 184". In the column assembly 182 of FIG. 11, it is to be noted that the shallow U-shape of the side plates 184 faces the column member 182*a*, and that the thicker sections 184" are welded to the flange tips of the H-shaped column member 182*a* by weld beads 186. Also seen in FIG. 11 is a support bracket 187 which is secured to the column member 182 between the side plates 184*a*, 184*b*, and provides a support ledge 187*a* at approximately the lower extent of these side plates. This support bracket 187 may be employed when full-length beam assemblies are to be lowered between side plates (recalling FIGS. 2 and 2A). In that assembly method, the end portions of the full-length beam assemblies rest upon the support brackets 187 (i.e., after placing the full-length beam assembly and removing support from a crane) preparatory to the field welding of the beam assemblies to the column assemblies, resulting in the formation of the beam-to-column joints, as described herein.

FIG. 12 provides a diagrammatic illustration of an alternative method of providing a spacing (or root gap at the welds of a column member to a pair of projecting side plates. Recalling the embodiment and method disclosed with reference to FIGS. 4 and 5, it will be remembered that in that embodiment small spacer blocks of steel or lengths of weld wire were utilized in preparation to welding the side plates to the column member as part of the process of making a column assembly. In the embodiment of FIG. 12, no such spacer blocks are employed. Instead, a spacing or root gap, indicated with an arrowed numeral 188 is created between the column member 190 and each side plate 192, 194 preparatory to welding, and is so maintained by fixing or supporting devices (not seen in the drawing Figure—but possibly including a fixture or jig, for example) during the welding process. The welding process produces weld beads 196 seen in FIG. 12. The result is that the side plates 192, 194 are spaced apart adjacent to the column member 190 by a dimension "D" extending from the column member 190 to the full extent of each side plate 192, 194, which is greater than the size of the column member itself.

Turning now to FIG. 13, an alternative method of providing for sufficient "rattle" space between projecting side plates of a column assembly is diagrammatically illustrated. Viewing FIG. 13, it is seen that in this case, similarly to that illustrated and described above with reference to FIGS. 6 and 7, the side plates 198 are intentionally cambered, or displaced from being truly straight such that the projecting distal end portions 198*a* of the side plates 198 angle away from one another. However, while in the embodiment of FIGS. 6 and 7, the contractions of weld beads were utilized to bring bowed side plates into or nearly into parallel alignment with one another, in the embodiment of FIG. 13, the finished welded side plates 198 are still angulated so that they diverge away from one another as they project outwardly from a column member 200. The result is a wedge shaped, or keystone shaped gap 202 between the projecting distal end portions 198*a* of side plates 198, as is seen in FIG. 13. A full-length beam assembly which is especially configured and constructed to be used in cooperation with column assemblies as illustrated in FIG. 13 is depicted herein (i.e., FIG. 30), and is described below.

Turing now to FIGS. 14 and 14A considered together, an alternative embodiment of construction for a side plate 204 according to this invention is illustrated. Again, this alternative embodiment is a plate weldment construction, including a relatively or comparatively thin plate portion 206 with distal end portions 206*a* which will project beyond and away from a column member (not seen in FIGS. 14 and 14A). Adjacent to the distal ends of the plate portions, the side plates define a row of vertically extending holes 208 or perforations for temporary and permanent fixing or supporting of a full-length beam assembly during erection of a building framework, as will be further described. As described above, the full-length beam assemblies to be used with these side plates will be somewhat shorter then the spacing between set and aligned column assemblies, so that a gap dimension will be defined between the end of the full-length beam and the column member of the column assembly. The side plates 204 will span across this gap dimension. For purposes of illustration, in FIGS. 14 and 14A, the gap dimension and location is illustrated with the character "G" and dashed lines across the side plate 204. It is to be noted in FIGS. 14 and 14A that adjacent their upper and lower edges, and spanning the gap "G", the side plates 204 include reinforcement features or members, indicated with the numeral 210. In the embodiment of FIGS. 14 and 14A, these reinforcement features or members take the form of localized, rather thin, blocks or areas of steel welded onto or deposited onto (as by welding with multiple passes leaving multiple unified weld beads) the side plate member 206. These blocks or reinforcing features are preferably rectangular in side elevation view of the side plate, and may be rectangular or trapezoidal shape in elevation view, as is best seen in FIG. 14A. Although not shown in FIGS. 14 and 14A, it is to be noted that the reinforcing members are not limited to being located within the outline of the side plates, but may extend or project outside of the outside edges of the side plates in order to more effectively add moment area or moment capacity about a neutral axis to the side plates. An embodiment of such a reinforcement is disclosed herein (see FIGS. 18, 18A).

Considering FIGS. 15 and 15A, another alternative embodiment of construction for a side plate 212 according to this invention is illustrated. This alternative embodiment is a plate weldment construction, including a relatively or comparatively thin plate portion 214 with distal end portions 214*a* which will project beyond and away from a column member (not seen in FIGS. 15 and 15A). Adjacent to the distal ends of the plate portions, the side plates define a row of vertically extending holes 216 or perforations for temporary and permanent fixing or supporting of a full-length beam assembly during erection of a building framework, as will be further described. Again, a gap dimension is illustrated in FIGS. 15 and 15A, and is located and illustrated with the character "G" and dashed lines across the side plate 214. Again, it is to be noted in FIGS. 15 and 15A that adjacent their upper and lower edges, and spanning the gap "G", the side plates 214 include reinforcement features or members, indicated with the numeral 218. In the embodiment of FIGS. 14 and 14A, these reinforcement features or members take the form of blocks of steel welded onto the side plate member 214. These blocks are rectangular in side elevation view of the side plate and include a recess (or fish mouth) 218*a*. The fish mouth blocks 218 may be rectangular in elevation view, as is best seen in FIG. 15A.

FIGS. 16 and 16A illustrate still another alternative embodiment of construction for a side plate 220 according to this invention. This embodiment for a side plate is also a plate weldment construction, including a relatively or comparatively thin plate portion 222 with distal end portions 222*a* which will project beyond and away from a column member (not seen in FIGS. 16 and 16A). Adjacent to the distal ends of the plate portions, the side plates define a row of vertically extending holes 224 or perforations for temporary and permanent fixing or supporting of a full-length beam assembly during erection of a building framework, as will be further described. Again, a gap dimension is defined with respect to the side plate 220, and is illustrated with the character "G" and dashed lines across the side plate 220. Again, it will be noted in FIGS. 16 and 16A that adjacent their upper and lower edges, and spanning the gap "G", the side plates 220 include reinforcement features or members, indicated with the numeral 226. In the embodiment of FIGS. 16 and 16A, these reinforcement features or members take the form of plural beads of weld metal placed onto the side plate member 222, and built up and out (i.e., possibly in plural layers or passes of weld metal) by successive welding passes in order to provide a sufficient depth and surface area of reinforcement of the side plate member at the location indicated. It will be noted in FIGS. 16 and 16A that the lines or beads of weld metal extend in a direction generally parallel with the length of the side plate member 222, while providing a body or mass of weld metal that has a vertical orientation (as viewed in side elevation view), although the invention is not so limited. In other words, the lines or beads of weld metal placed on the plate member 222 could extend transverse to the length of the plate member or in some other direction within the scope of this invention.

Turning now to FIGS. 17 and 17A yet another alternative embodiment of a side plate 228 according to this invention is illustrated. Again, this alternative embodiment is a plate weldment construction, including a relatively or comparatively thin plate portion 230 with distal end portions 230*a* which will project beyond and away from a column member (not seen in FIGS. 17 and 17A). Adjacent to the distal ends of the plate portions, the side plates define a row of vertically extending holes 232 or perforations for temporary and permanent fixing or supporting of a full-length beam assembly during erection of a building framework, as will be further described. A gap dimension "G" is indicated on FIG. 17 with dashed lines across the side plate 228. Again, adjacent their upper and lower edges, and spanning the gap "G", the side plates 228 include reinforcement features or members, indicated with the numeral 236. In the embodiment of FIGS. 17 and 17A, these reinforcement features or members take the form of oval or elliptical blocks of steel welded onto the side plate member 230. These oval or elliptical blocks are rectangular in elevation view, as is best seen in FIG. 17A.

FIGS. 18 and 18A illustrate yet another alternative construction of a reinforcement for a side plate member (and for a beam, or beams, to column joint). Viewing first FIG. 18, it is seen that a column assembly 238 includes a column member 238*a* of H-section configuration, which will be familiar to the reader in view of the disclosure above. The column assembly 238 carries a pair of side plates 240*a*, 240*b*, only the first of these side plates (240*a*) being visible in FIG. 18. The other side plate, 240*b*, is located directly behind side plate 240*a* as seen in the side elevation view of FIG. 18 (i.e., seen in the plan view of FIG. 18A) A full-length beam assembly 242 is associated with column assembly 238, and defines an end gap "G" therewith, as will also by now be familiar in view of the disclosure above. However, in this embodiment, the column assembly 238 also carries continuity plates (or horizontal shear plates) 244 (only one of which is seen in FIG. 18) which are each inset into the space between the flanges of the H-section column member 238*a* on opposite sides of the web of this column member, and are joined to the column assembly as by welding. The continuity plates are in this embodiment generally of T-shaped configuration, as is best seen in FIG. 18*a*, and include a leg portion (or pair of such leg portions) 236 which are extended along the adjacent surface (i.e., the top surface as seen in FIGS. 18 and 18*a*) of the side plate 240*a* and across the gap "G". The continuity plate projects somewhat across the top of the side plate 240*a*, and is welded thereto along the length of the continuity plate 244 by a fillet weld indicated with arrowed numeral 248 which weld extends across the gap "G". Thus, the side plate 240*a* and continuity plate 244 are united into a unitary structure by the weld 248. However, as is also seen in FIG. 18, additional weld beads (indicated at 250) are also extended across the gap "G" and adjacent to the weld 248. The additional weld beads may be seen as an expansion of the weld area deposited on the side plate 240*a*, 240*b*. Thus, the leg portion 246 and welds 248, 250 reinforce the side plate 240*a* in the area of gap "G".

Turning now to FIG. 19, a fragmentary view of a full-length beam assembly 254, and particularly of the end portion 254*a* of this beam assembly is illustrated. As is seen in FIG. 19, this full-length beam assembly 254 includes a steel structural beam member 254*b* generally of I-beam sectional shape. That is, the member 254*b* may have a width of from about 6 inches to about 16 inches, and may have a vertical depth of from about 18 inches to as much as 44 inches or more, depending on the specifics of the building structure of which this beam assembly makes up a part. At the end portion 254*a* of this full-length beam assembly, a pair of cover plates 256 and 258 are joined to (i.e., welded to) the beam member 254*b*. As is seen in FIG. 19, the upper cover plate 256 is narrower than the lower cover plate 258, although these cover plates have the same (or about the same) length along the beam member 254*b*, extending from its end a distance along its length. The cover plates are united with the beam 254 by welding along their length, as is seen in FIG. 19.

FIG. 20 now illustrates a method of joining a full-length beam assembly 254 as seen in FIG. 19 to a set column assembly, indicated generally with the numeral 260. It will be recalled that the column assembly 260 includes side plates 262*a*, 262*b*, projecting therefrom toward the next-adjacent column assembly, and that the full-length beam assembly defines an end gap "G" with these column assemblies. Recalling FIG. 3A, in which the full-length beam assemblies were first moved into alignment between spaced apart column assemblies, and then are moved vertically upwardly between the projecting side plates of these column assemblies, it will be seen in FIG. 20, that this method has been used to position the end portion 254*a* of the beam assembly 254 between the side plates 262*a*, 262*b*. In this position, the beam assembly 254 is temporarily supported (as will be further explained) while fillet welds 264 are used to unite the upper cover plate 256 to the side plates 262*a*, 262*b* adjacent to the inside upper extent of these side plates. Similarly, fillet welds 266 are employed to unite the lower cover plate 258 to the outside lower extent of the side plates 262*a*, 262*b* (only one of the welds 266 being shown in FIG. 20). Viewing FIG. 20 it is to be noted that these welds 264, 266 are each applied in a generally downward direction, indicated by arrow 268, which indicates generally the orientation of the welding torch used to place the welds 264, 266. Thus, it will be appreciated that the welds 264, 266 are easy to place with field welding equipment and techniques. Once the welds 264, 266 are placed at each end of the beam assembly, the full-length beam assembly 254 unites the adjacent column assemblies and the beam assembly into an integral structure, including a beam-to-column joint assembly (indicated with numeral 270) at each column assembly, and at each end portion of the full-length beam assembly. It will further be understood that for simplicity of illustration, some components of the joint assembly 270 have been omitted or are not yet installed on this joint assembly at the time of illustration in FIG. 20.

Turning now to FIG. 21, an embodiment of full-length beam assembly 272 which provides for simplified and expedient temporary (and permanent) support of the beam assembly during and after erection of a building framework is illustrated. It will be appreciated that FIG. 21 is a fragmentary perspective view showing the beam member 272*a*, and only one end portion 272*b* of a full-length beam assembly 272, and that the beam assembly will have a similar or identically configured end portion at its other end (not seen in FIG. 21). Viewing FIG. 21, it is seen that the end portion 272*b* includes upper (274) and lower (276) cover plates, which will be familiar in view of the disclosure above. As illustrated in FIGS. 19 and 20, the upper cover plate 274 is narrow enough to go between a pair of projecting side plates at a column assembly, while the lower cover plate 276 is wide enough to span those side plates and be welded to those side plates at the outside lower extent of the side plates, as illustrated in FIG. 20. However, the end portion 272*b* also includes a vertically extending shear and support bracket member, indicated with the arrowed numeral 278. This bracket member 278 includes a first leg 278*a*, which is welded to the web of beam member 272*a* as indicated at arrowed numeral 280. A second leg 278*b* of the bracket member 278 extends generally parallel with the length of the beam assembly 272, and is provided in this embodiment with vertically spaced apart and aligned holes 278*c* (three such holes 278*c* are shown for illustration, although the invention is not so limited). Most preferably, the second leg 278*b* defines an outer face or surface 278*d*, which aligns vertically with the tip or outer edge of the upper cover plate 274. Also, preferably, the beam assembly 272 includes such a shear and support bracket member 278 on each of its opposite sides, as will be better understood in view of the following description.

Turning now to FIGS. 22, 23, and 24, considered together and generally in numerical sequence, it is seen in FIG. 22 that the end portion 272*b* of the full-length beam assembly 272 has been lifted vertically upwardly between the extending side plates of a column assembly, recalling the illustrations and descriptions of the column assemblies seen in FIGS. 8 and 8A. This lifting or vertical movement of the full-length beam assembly is continued until it reaches its designed location, with the top face or surface of the lower cover plate 276 in contact with the bottom edge of the side plates 132. As is seen in FIG. 22, a side-to-side rattle space "R" exists between the side plates and the upper cover plate 274. Thus, the full-length beam assembly can be positioned in alignment with the column assemblies and at a level just below the bottom edges of side plates 132, and can then be lifted without interference vertically upwardly into place between the side plates 132, until the lower cover plates contact the bottoms of the side plates 132.

In FIGS. 22-24 for clarity and ease of illustration, the number of holes in the shear and support bracket members (and in the side plates 132—recalling FIG. 8) has been shown to be two (2), although the invention is not so limited. That is, the shear and support brackets and side plates may have any number of bolt holes according to necessity and design requirements. But, viewing FIG. 22, it is seen that the full-length beam assembly is "self shoring," and that as a first temporary support for the full-length beam assembly (while it is still supported by a crane), a pair of spud wrenches have been inserted at their tapered handle ends 282 through the holes 133 of the side plates 132 and into the holes 278*c* of the shear and support brackets 278. Thus, it is understood that these spud wrench handles and the brackets 278 serve as a first temporary support and stabilization for the full-length beam assembly 272 while being placed into its design position between aligned set column assemblies. Also, as is seen in FIG. 22, a worker has installed a pair of bolts 284 through the other holes 278*c* and 133, and has attached a pair of nuts to these bolts (i.e., on the outside face of side plates 132). Subsequently, before support to the full-length beam assembly 272 from a crane is removed, another pair of bolts 284 (best seen in FIG. 23) is placed as described above, in substitution for the spud wrench handles. This is done at both ends of the full-length beam assembly 272. The bolts 284 serve as a second temporary support for the full-length beam assembly 272. As thus secured, the crane support can be removed from the beam assembly 272. Further, floor decking (not seen in the drawing Figures) can now be placed upon the full length beam assembly, allowing workmen to walk on this floor decking and considerably improving the safety of the working conditions for these workmen.

In FIG. 23, it is seen that the bolts securing the side plates 132 to brackets 278 have been tightened, drawing the rattle space "R" closed, and bringing the side plates into contact or close proximity with the sides of the top cover plate 274.

In FIG. 24, it is seen that weld beads 286 have been placed, uniting the beam assembly 272 with a column assembly, and producing a beam-to-column joint assembly 288 in accordance with this invention. An additional option is shown also in FIG. 24, in which weld bead 290 further unites brackets 278 with side plates 132. This welding of brackets 278 to the side plates 132 provides additional shear capacity in the beam-to-column joint assembly.

FIG. 25 illustrates an alternative structure and method for drawing together a pair of side plates 132 of a column assembly after an end portion of a full-length beam assembly has been placed between these side plates. By way of example, it is seen that the end portion of the full length beam assembly may be configured like that seen in FIG. 19. In this case, a large C-clamp type of apparatus 300 has been placed on the side plates 132, with the rattle space "R" still existing. In preparation to welding the side plates 132 to the top and bottom cover plates of the full-length beam assembly, the clamp 300 is tightened, bringing the side plates into contact or close proximity with the top cover plate. As so clamped and while still supported by a crane or other support device, at least a portion of the weld between the top cover plate and side plates is placed. Preferably, at least a portion of the weld between the lower cover plate and side plates is also placed before support from a crane or other support device is removed from the beam assembly. Once such a full-length beam assembly has been "tacked" (i.e., partially welded) in place at both ends in this way, the welds may be finished without support from a crane or other support device, resulting in a beam-to-column joint assembly in accord with this invention.

Considering now FIG. 26, another alternative structure and method is depicted for drawing together a pair of side plates 302 of a column assembly after an end portion of a full-length beam assembly 304 has been placed between these side plates. Again, it is seen that the end portion of the full length beam assembly may be configured like that seen in FIG. 19. But, in this case, the side plates 302 have each been provided with a sacrificial tab, ear, or bracket 306. After the full-length beam assembly 304 is placed at its end portion between the side plates (recalling the disclosure above) a tie bolt 308 is inserted through the tabs 306, as seen in FIG. 26. It will be appreciated that when the tie bolt 308 is drawn tight, the side plates 302 are drawn together, eliminating the rattle space between the side plates and the top cover plate of the beam assembly. Subsequently, weld material 310 is placed at the cover plate to side plate locations, as is seen in FIG. 26. Again, once such a full-length beam assembly has been welded in place at both ends in this way a beam-to-column joint assembly in accord with this invention is formed.

Turning now to FIGS. 27, 28, and 29, considered together and generally in numerical sequence, it is seen in FIG. 27 that the end portion 314*a* of a full-length beam assembly 314 has been lifted vertically upwardly between the extending side plates 316 of a column assembly 318. The column assembly 318 may be like that shown in FIG. 8 or 8A, or may be of another configuration having extending side plates. Recalling the description above, it will be understood that a side-to-side "rattle" space "R" exits between the side plates 316 and the upper cover plate 320 of the full-length beam assembly. Thus, the full-length beam assembly 318 can be positioned in alignment with two spaced apart column assemblies at a level just below the bottom edges of side plates 316, and can be lifted without interference vertically upwardly into place between the side plates, until the lower cover plates 322 contact the bottoms of the side plates 316, as is seen in FIGS. 27 and 29.

It will be seen in FIGS. 27, 28, and 29, that the web 314*b* of the beam member end portion 314*a* of the full length beam assembly 314 defines a through hole 324. Similarly, the side plates 316 each define similar through holes 326, which align with the hole 324 when the end portion 314*a* is placed between the side plates 316 in its design position. This alignment of the holes 324 and 326 is best seen in FIG. 27. As FIGS. 28 and 29 show, a tension rod or bolt 328 is placed through the aligned holes 324 and 326. The pair of brackets 325 (only one bracket shown in FIG. 27) are omitted in the partial plan view of FIG. 28 for clarity. When the tension rod 328 is tightened, the "rattle" space "R" between the side plates 316 and the edges of the top cover plate 320 is substantially eliminated, by drawing the side plates 316 toward one another. In this condition, the cover plate 320 is welded to the upper inside portion of the side plates 316, and the lower cover plate 322 is welded to the lower outer extent of the side plates 316, recalling the description of FIGS. 22-26 above.

Turning now to FIGS. 30, 31, and 32, alternative embodiments of column assemblies 330, 332, and 334 are diagrammatically illustrated in cross sectional view taken transverse to the column assemblies and immediately above projecting pairs of side plates 336, 338, and 340, respectively. Comparing the illustrations of FIGS. 30, 31, and 32 to those of FIGS. 4, 5, and 12, it is seen that an intentional root gap (recalling FIGS. 4, 5, and 12) is not employed. On the other hand, flaring or displacing the side plates away from one another at their distal ends (FIGS. 6, 7, 13) may be employed, as is seen in FIG. 30. However, the expedient employed in the embodiments of column assembly and full length beam assemblies seen in FIGS. 30, 31, and 32 (i.e., an expedient allowing full-length beams to be assembled between projecting side plates with a sufficient rattle space, and preparatory to welding), is to fit at least the upper cover plate, or at least the lower cover plate, of a full-length beam assembly to the spacing actually existing between the projecting side plates such that a sufficient "rattle" space "R" is provided. In FIG. 30, it is seen that the projecting side plates 336 flare away from one another so that they are spaced further apart at their distal ends than they are at the column member 330*a*. Consequently, the end portion 342*a* of the full-length beam 342 is provided with a cover plate 344 which is generally "keystone" shaped, having a narrower end 344*a* proximate to the column member 330*a*, and a wider end 344*b* spaced from the column member 330*a*. The width of the cover plate 344 is made to match the spacing between the side plates such that a sufficient "rattle" space "R" exists for fitting of the end portion 342*a* between the side plates 336, and such that this rattle space can be substantially eliminated by drawing the side plates slightly (i.e., sufficiently) toward one another preparatory to welding of the side plates to the end portion of the full-length beam assembly 342 to provide a beam-to-column joint according to this invention.

In FIG. 31, it is seen that the projecting side plates 338 are either substantially parallel or that perhaps they even converge slightly toward one another so that they are spaced less far apart at their distal ends than they are at the column member 332*a*. Consequently, the end portion 346*a* of the full-length beam 346 is in this embodiment provided with a cover plate 348 having an end 348*a* proximate to the column member 332*a*, and an end 348*b* spaced from the column member 332*a*. The width of the cover plate 348 again is made to match the spacing between the side plates 338 such that a sufficient "rattle" space "R" exists for assembly of the end portion 346*a* between the side plates 338. In this case, the cover plate 348 is made with end 348*a* the same width (i.e., rectangular), or narrower, or even wider, than end 348*b*. And again, this rattle space "R" can be substantially eliminated by drawing the side plates toward one another preparatory to welding of the side plates to the end portion of the full-length beam assembly 346.

FIG. 32 illustrates an embodiment of the invention in which the side plates 340 are allowed to converge significantly and visually, as is seen in this drawing Figure somewhat exaggerated for clarity of illustration. So, at their distal ends, the projecting side plates 340 converge toward one another so that they are spaced less far apart at their distal ends than they are at the column member 334*a*. Consequently, in this embodiment the end portion 350*a* of a full-length beam 350 is provided with a cover plate 352 which is noticeably "keystone" shaped, but which is tapered in the opposite direction from the embodiment seen in FIG. 30 (i.e., cover plate end 350*a* is wider than end 350*b*). However, even though the cover plate 352 of FIG. 32 could not be fitted horizontally between the projecting side plates 340, it will fit with sufficient rattle space when the end portion 350*a* of full-length beam assembly 350 is moved vertically from below or vertically from above the projecting side plates either upwardly or downwardly between the pair of projecting side plates 340.

FIGS. 33 and 33A illustrate yet another alternative embodiment of the present invention, in which a column assembly includes a bracket or shelf for supporting an end portion full-length beam assembly, and the full-length beam assembly includes a stud or fitting for interlocking with this column assembly during erection and preparatory to welding of the full-length beam assembly and column assembly into a unitary whole. Viewing FIG. 33, it is seen that a column assembly 354 includes a pair of projecting side plates, generally indicated with arrowed numeral 356. Adjacent to the lower extent of the projecting side plates, and positioned generally between these side plates (as is best seen in FIG. 33A), the column assembly 354 includes a bracket or shelf member 358. Most preferably, this bracket or shelf member 358 may be formed of sufficiently heavy angle iron or plate that it is strong enough to support an end portion of a full-length beam assembly preparatory to welding of the full-length beam assembly to the column assembly at the side plates.

As is illustrated in FIG. 33A, the bracket member 358 preferably includes a vertically extending through hole 358*a*. Also as is seen in FIG. 33A, the end portion 360*a* of a full-length beam assembly 360 includes a downwardly projecting stud or stem 360*b*, which when the full-length beam assembly 360 is positioned adjacent to the column assembly preparatory to being lowered between the projecting side plates 356, aligns with the hole 358*a*. Thus, it will be understood that when the full-length beam assembly 360 is lowered between the projecting side plates 356, the stud or stem 360*b* is received into the hole 358*a* (i.e., at each end of the full-length beam assembly), as the full-length beam assembly comes to rest upon the projecting bracket 358. Those ordinarily skilled in the pertinent arts will recognize that support from a construction site crane can then be removed, and further preparations for bringing the side plates 356 sufficiently close to the cover plates of the full-length beam assembly can be carried out. Thus, welding of the full-length beam assembly to the column assembly to provide a beam-to-column joint according to this invention can be carried out without the further need for support from a construction site crane.

Turning now to FIGS. 34 and 34A, it is seen that these Figures diagrammatically depict yet another embodiment of a side plate construction according to this invention, which is similar in some respects to those depicted and described above. However, the embodiment of side plate illustrated in FIGS. 34 and 34A is particularly efficient in its use of steel (or other material) for construction of the side plate. Viewing now FIGS. 34 and 34A together, it is seen that is side elevation view, the side plate 362 is generally rectangular, and may form a part of and span across the horizontal dimension of a column member 364 (indicated by dashed lines) of a column assembly (not seen in FIG. 34). As mentioned and explained above, the side plate 362 may include holes 362*a* or perforations near the distal ends of this side plate for purposes explained above. Importantly, as is best seen in FIG. 34A, the side plate is not of uniform shape considered vertically in end view or cross section. That is, the side plate 362 includes an upper and a lower portion 366, 368 which are larger in cross section (i.e., thicker) than the remainder of the side plate 362, and provide a significant increase in the stiffness of side plate 362 about its neutral axis, as well as a comparatively large moment capacity about a neutral axis of the side plate 362. Accordingly, it is seen that the side plate 362 includes a central portion 370 which is comparatively thin, and provides a comparatively smaller moment about a neutral axis of the side plate. However, where the side plate 362 is to span a gap "G" as has been discussed above, still greater area and moment capacity about a neutral axis of the side plate 362 is desired. To this end, the side plate 362 includes added on reinforcement members 372, which will be familiar to the reader by this point in the disclosure of the present invention.

While the present invention has been illustrated and described by reference to preferred exemplary embodiments of the invention, such reference does not imply a limitation on the invention, and no such limitation is to be inferred. Rather, the invention is limited only by the sprit and scope of the appended claims giving full cognizance to equivalents in all respects.

We claim:

1. A building framework comprising:

at least a pair of vertical column assemblies; each column assembly of said pair of column assemblies having a vertically elongate column member defining a horizontal dimension and a pair of horizontally spaced vertically and horizontally extending side plates spanning the horizontal dimension of said column member and projecting generally horizontally toward the other column assembly of said pair;

a full-length beam assembly including a beam member defining an end gap with each column member, and said full-length beam assembly including at least one cover plate at each opposite end of said full-length beam assembly; said at least one cover plate being wider in horizontal lateral dimension transverse to a length dimension of said full-length beam assembly than a spacing between said pair of projecting side plates, and each end portion of the beam member being received between a respective pair of projecting side plates of a respective column assembly.

2. The building framework of claim 1, wherein there are a pair of cover plates at each end of the beam member, each pair of cover plates being welded in the horizontal welding position as opposed to the overhead welding position to said pair of side plates at a respective one of said pair of column assemblies, so as to provide a beam-to-column joint assembly at each of said pair of column assemblies.

3. The building framework of claim 1, wherein there are a pair of cover plates at each end of the beam member, said pairs of cover plates including an opposite pair of upper cover plates and an opposite pair of lower cover plates each respectively disposed adjacent to opposite ends of said beam member.

4. The building framework of claim 3 wherein said lower pair of cover plates are wider than said side plate spacing, whereby said lower pair of cover plates are disposed adjacent to a lower edge of said projecting side plates, and are welded thereto along a lower outer edge of said projecting side plates whereby said lower wider cover plates can be welded in the horizontal welding position as opposed to the overhead welding position.

5. The building framework of claim 3 wherein said full-length beam assembly further includes at one of the end portions thereof a pair of opposite bracket members extending vertically between upper and lower flange portions of said beam member, and each of said pair of bracket members including a respective first leg portion attaching to a web portion of said beam member, and a second leg portion extending from said first leg away from an adjacent end of said beam member in a direction along the length of said beam member, and said second leg portion further providing an outer surface disposed in vertical alignment with an outer edge of one of said pair of cover plates.

6. The building framework of claim 5 wherein said second leg of said bracket member defines at least one through hole, and a projecting side plate of said column assembly also defining at least one through hole aligning with said through hole of said bracket member in a design position of said full-length beam assembly relative to said projecting side plates, whereby a bolt connecting said second leg portion of said bracket member to said side plate provides support to said full-length beam assembly, and further said bolt when tightened drawing said side plate toward said full-length beam assembly preparatory to welding of said side plate and cover plates.

7. The building framework of claim 1 wherein a vertical column assembly includes a root gap spacing introduced between at least one of said pairs of projecting side plates, and said column member of said column assembly, whereby, said root gap spacing increases a lateral spacing between said projecting pair of side plates.

8. The building framework of claim 1 wherein each end of the beam member of the full-length beam assembly includes another cover plate sized to fit between a projecting pair of side plates of a column assembly with a determined rattle space, whereby an end portion of said full-length beam assembly can be moved vertically upwardly or downwardly between said pair of projecting side plates of said column assembly prior to said full-length beam assembly being temporarily supported between said side plates preparatory to welding said cover plate to said projecting side plates.

9. The building framework of claim 1 wherein at least one side plate of said pair of projecting side plates of one of said column assemblies is composed of plate material, and said one side plate further including a reinforcing member or mass disposed at and spanning said end gap adjacent to an upper or a lower extent of said one side plate.

10. The building framework of claim 9 wherein said at least one side plate includes both an upper and a lower reinforcing member or mass disposed at and spanning said end gap adjacent to respective upper and lower extents of said one side plate, whereby, said reinforcing members or masses increase the moment capacity with respect to a neutral axis of one said side plate at and spanning said end gap.

11. A method of making a building framework, said method comprising steps of:

providing a pair of vertical column assemblies; and configuring each of said pair of vertical column assemblies to include a vertically elongate column member defining a horizontal dimension, providing each of said vertical column assemblies additionally with a respective pair of horizontally spaced vertically and horizontally extending side plates spanning the horizontal dimension of the respective one of said column members and projecting generally horizontally toward the other column assembly of said pair;

providing a full-length beam assembly for being disposed between said pairs of projecting side plates of said pair of column assemblies, providing for said full-length beam assembly to be attached to said projecting side plates, said full-length beam assembly including a beam member for defining an end gap with each column member of said pair of column assemblies;

including in said full-length beam assembly a pair of opposite cover plates each extending along an end portion of said beam member at each opposite end of said full-length beam assembly; and disposing one of said end portions of said beam member between a respective pair of projecting side plates of a respective one of said pair of column assemblies;

whereby one of said cover plates at one of said opposite ends of the full-length beam assembly can be attached to said respective pair of side plates to form a beam-to-column joint assembly;

and further including the step of configuring at least one of said pair of cover plates at one of the opposite ends of said full-length beam assembly to be wider in horizontal lateral dimension transverse to a length dimension of said full-length beam assembly than a spacing between said pair of projecting side plates.

12. The method of claim 11, further including welding said one cover plate to said respective pair of side plates at said respective one of said pair of column assemblies along the length of said cover plates.

13. The method of claim 11 further including providing said full-length beam assembly with an end portion at each opposite end thereof, and a pair of cover plates at each end portion, each of said pairs of cover plates at each end portion including an upper cover plate and a lower cover plate, and disposing said pairs of cover plates each respectively adjacent to one of the end portions of said beam member.

14. The method of claim 13 including the step of making said lower pair of cover plates wider than said spacing between said projecting pair of side plates, whereby said lower wider pair of cover plates are disposed adjacent to and are welded in the horizontal welding position as opposed to the overhead welding position to said projecting pairs of side plates along a lower outer edge portion thereof.

15. The method of claim 11 further including providing said full-length beam assembly at opposite end portions thereof with an opposite pair of bracket members, configuring said opposite pair of bracket members each to extend vertically between upper and lower flange portions of said beam member, and including in each of said opposite pair of bracket members a respective first leg portion attaching to a web portion of said beam member, and providing each of said opposite pair of bracket members with a second leg portion extending from said first leg in an opposite direction from an adjacent end of said beam member, and configuring said pair of bracket member so that said second leg portion extends generally parallel with a length dimension of said beam member and further provides an outer surface disposed generally in vertical alignment with an outer edge of one of said pair of cover plates, whereby said projecting pair of side plates may each be attached to and drawn toward a respective one of said opposite pair of bracket members preparatory to attaching said side plates to said cover plates.

16. A method of making a building framework, said method comprising steps of:

providing a pair of vertical column assemblies; and configuring each of said pair of vertical column assemblies to include a vertically elongate column member defining a horizontal dimension, providing each of said vertical column assemblies additionally with a respective pair of horizontally spaced vertically and horizontally extending side plates attached to said column member with a rattle space between inner surfaces of said pair of side plates, the side plates spanning the horizontal dimension of the respective one of said column members and projecting generally horizontally toward the other column assembly of said pair;

providing the full-length beam assembly for being disposed between said pairs of projecting side plates of said pair of column assemblies, providing for said full-length beam assembly to include a full-length beam member for defining an end gap with each column member of said pair of column assemblies;

after attaching said side plates to said column member, disposing end portions of said full-length beam assembly between said projecting pairs of side plates of respective ones of said pair of column assemblies, whereby said end portions of said full-length beam assembly can be moved at least one of vertically upwardly or downwardly into the rattle space between said pair of projecting side plates of said column assemblies preparatory to attaching said end portions to said projecting side plates.

17. The method of claim 16 further comprising after attaching said side plates to said column member and before disposing end portions of said full-length beam assembly between said projecting pairs of side plates forcing apart the side plates attached to said column member.

18. The method of claim 16 further comprising, after disposing end portions of said full-length beams between said pairs of side plates, drawing the side plates toward said full-length beam assembly.

19. A column assembly and full-length beam assembly joint in a building framework, the joint comprising:

a column assembly including a vertically oriented column member, and first and second horizontally spaced vertically oriented side plates attached to horizontally opposite sides of said column member and projecting generally horizontally outward from said column member;

a full-length beam assembly including a horizontally oriented beam member having a length sufficient to span a distance between said column member and an adjacent column member in the building framework, said beam member having an end portion received between the first and second side plates of the column assembly, an upper cover plate mounted on an upper surface of the beam member at the end portion and a lower cover plate mounted on a lower surface of the beam member at the end portion, the upper and lower cover plates projecting laterally outwardly from the upper and lower surfaces, respectively, of said beam member;

a horizontal weld attaching the upper cover plate to the first side plate and a horizontal weld attaching the lower cover plate to the first side plate, the horizontal welds being located on upwardly facing surfaces of the upper and lower cover plates whereby the horizontal welds can be made in the horizontal welding position as opposed to the overhead welding position.

20. A column assembly and full-length beam assembly joint of claim 19 further comprising a horizontal weld attaching the upper cover plate to the second side plate and a horizontal weld attaching the lower cover plate to the second side plate, the horizontal welds being located on upwardly facing surfaces of the upper and lower cover plates whereby the horizontal welds can be made in the horizontal welding position as opposed to the overhead welding position.

21. A column assembly and full-length beam assembly joint of claim 20 wherein the side plates have vertically spaced upper edges and lower edges, the lower cover plate engaging the lower edges of the side plates, the horizontal welds attaching the lower cover plate to the side plates being located on respective laterally outer sides of the side plates whereby the lower cover plate can be welded in the horizontal welding position as opposed to the overhead welding position.

22. A column assembly module for a building framework, said column assembly comprising:

a vertically elongate column member defining a first horizontal dimension;

a pair of horizontally spaced vertically and horizontally extending side plates spanning the first horizontal dimension of said column member and projecting together and generally in parallel horizontally therefrom;

the column member having a surface facing an end of beam member when assembled in the building framework, the surface having a second horizontal dimension transverse to the first horizontal dimension;

said pair of side plates of the column assembly defining a rattle space between opposing inner surfaces of said pair of side plates such that a horizontal dimension extending between the opposing inner surfaces of said side plates that is greater than the second horizontal dimension of the column member surface;

whereby a full-length beam member may be disposed between pairs of projecting side plates of a spaced apart pair of such column assembly modules to be welded thereto providing a beam-to-column joint assembly.

23. A full-length beam assembly for connecting in a building framework to a column assembly having a column member and side plates attached to the column member, the full-length beam assembly comprising a beam member having a length sufficient to span between adjacent column members in the building framework, the beam member including an upper surface and a lower surface, the upper surface and lower surface each having a width, and at least one upper cover plate mounted on an upper surface of the beam member and at least one lower cover plate mounted on a lower surface of the beam member, the upper cover plate projecting laterally outward from the upper surface of the beam member in a widthwise direction of the beam member and the lower cover plate projecting outwardly from the lower surface of the beam member in a widthwise direction of the beam member, the lower cover plate projecting outwardly from the lower surface of the beam member a distance greater than a distance the upper cover plate projects outwardly from the upper surface of the beam member such that when the full-length beam assembly is joined to the column assembly, the upper cover plate resides between the side plates and the lower cover plate engages a lower edge of at least one of the side plates.

* * * * *